US009865187B2

(12) United States Patent
Wen et al.

(10) Patent No.: US 9,865,187 B2
(45) Date of Patent: Jan. 9, 2018

(54) TFT ARRAY SUBSTRATE, DISPLAY PANEL AND DISPLAY DEVICE

(71) Applicants: Shanghai Tianma Micro-Electronics Co., Ltd., Shanghai (CN); Tianma Micro-Electronics Co., Ltd., Shenzhen (CN)

(72) Inventors: Lin Wen, Shanghai (CN); Lei Li, Shanghai (CN); Fen Wan, Shanghai (CN)

(73) Assignees: SHANGHAI TIANMA MICRO-ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 407 days.

(21) Appl. No.: 14/576,130

(22) Filed: Dec. 18, 2014

(65) Prior Publication Data

US 2015/0379919 A1 Dec. 31, 2015

(30) Foreign Application Priority Data

Jun. 30, 2014 (CN) ..... 2014 1 0309116

(51) Int. Cl.
*G09G 3/00* (2006.01)
*G09G 3/20* (2006.01)

(52) U.S. Cl.
CPC ..... *G09G 3/003* (2013.01); *G09G 3/20* (2013.01); *G09G 2310/0245* (2013.01); *G09G 2310/0248* (2013.01); *G09G 2310/0267* (2013.01); *G09G 2310/0286* (2013.01); *G09G 2310/062* (2013.01)

(58) Field of Classification Search
CPC .. G09G 3/003; G09G 3/20; G09G 2310/0245; G09G 2310/0248; G09G 2310/0267; G09G 2310/0286; G09G 2310/062
See application file for complete search history.

(56) References Cited

U.S. PATENT DOCUMENTS 9,449,548 B2 * 9/2016 Shin ..... G02B 27/2264
2004/0012671 A1 * 1/2004 Jones ..... H04N 13/0409 348/51

(Continued)

FOREIGN PATENT DOCUMENTS

CN 102547320 A 7/2012
CN 103631023 A 3/2014

*Primary Examiner* — Sejoon Ahn
(74) *Attorney, Agent, or Firm* — Anova Law Group, PLLC

(57) ABSTRACT

A TFT array substrate is disclosed. The substrate includes a plurality of gate lines, and a first gate drive circuit, where the first gate drive circuit includes m levels of first repeat units. Each level of first repeat unit includes a first shift register. The substrate also includes a second gate drive circuit, where the second gate drive circuit includes n levels of second repeat units. Each level of second repeat unit includes a second shift register. The substrate also includes a first start signal line and a first start transistor, where a drain of the first start transistor is electrically connected with the first start signal line. The substrate also includes a second start transistor, where a drain of the second start transistor is electrically connected with the first start signal line.

7 Claims, 20 Drawing Sheets

(56) References Cited

U.S. PATENT DOCUMENTS

| | | | | |
|---|---|---|---|---|
| 2005/0052439 | A1* | 3/2005 | Liou | G09G 3/20 345/204 |
| 2005/0156859 | A1* | 7/2005 | Jang | G09G 3/20 345/100 |
| 2011/0221721 | A1* | 9/2011 | Tsou | G09G 3/20 345/206 |
| 2011/0228894 | A1* | 9/2011 | Wang | G11C 19/28 377/80 |
| 2012/0162206 | A1* | 6/2012 | Nam | G09G 3/003 345/419 |
| 2013/0257925 | A1* | 10/2013 | Kim | H04N 13/0434 345/691 |
| 2015/0022507 | A1* | 1/2015 | Yao | G09G 3/003 345/206 |
| 2015/0022510 | A1* | 1/2015 | Yao | G09G 3/3659 345/211 |
| 2015/0049853 | A1* | 2/2015 | Lin | G11C 19/28 377/64 |
| 2016/0093262 | A1* | 3/2016 | Choi | G09G 3/003 345/204 |
| 2016/0171945 | A1* | 6/2016 | Yao | G09G 3/3648 345/212 |

* cited by examiner

TFT ARRAY SUBSTRATE, DISPLAY PANEL AND DISPLAY DEVICE

CROSS-REFERENCES TO RELATED APPLICATIONS

This application claims the benefit of priority to Chinese Patent Application No. 201410309116.3, filed with the Chinese Patent Office on Jun. 30, 2014 and entitled "TFT ARRAY SUBSTRATE, DISPLAY PANEL AND DISPLAY DEVICE" the content of which is incorporated herein by reference in its entirety.

TECHNICAL FIELD

The present invention relates to the field of display technologies and particularly to a TFT array substrate, a display panel and a display device.

BACKGROUND OF THE INVENTION

Display devices are becoming increasingly popular. The problem of inconvenient conversion between a 2D display effect and a 3D display effect of a display device exists in practical applications.

BRIEF SUMMARY OF THE INVENTION

One inventive aspect is a TFT array substrate, including a plurality of gate lines, and a first gate drive circuit, where the first gate drive circuit includes m levels of first repeat units. Each level of first repeat unit includes a first shift register including a first input terminal, and a first output terminal connected with a corresponding gate line. The substrate also includes a second gate drive circuit, where the second gate drive circuit includes n levels of second repeat units. Each level of second repeat unit includes a second shift register including a second input terminal, and a second output terminal connected with a corresponding gate line. The substrate also includes a first start signal line. The substrate also includes a first start transistor, where a drain of the first start transistor is electrically connected with the first start signal line, a source of the first start transistor is electrically connected with the first input terminal of the first shift register of the first level of first repeat unit, and a gate of the first start transistor is electrically connected with a first control line. The substrate also includes a second start transistor, where a drain of the second start transistor is electrically connected with the first start signal line, a source of the second start transistor is electrically connected with the second input terminal of the second shift register of the first level of second repeat unit, and a gate of the second start transistor is electrically connected with a second control line. Among the second to m-th levels of first repeat units, the first input terminal of the first shift register in an i-th level of first repeat unit is electrically connected with the first output terminal of the first shift register in an (i−1)-th level of first repeat unit. In addition, among the second to n-th levels of second repeat units, the second input terminal of the second shift register in i-th level of second repeat unit is electrically connected with the second output terminal of the second shift register in (i−1)-th level of second repeat unit. Each of m, n and i are positive integers, and i is greater than or equal to 2 and less than or equal to at least one of m and n.

BRIEF DESCRIPTION OF THE DRAWINGS

The drawings described here are intended to provide further understanding of the invention and constitute a part of the invention but not limit the invention. In the drawings.

DETAILED DESCRIPTION OF THE PREFERRED EMBODIMENTS

Figure 1A:
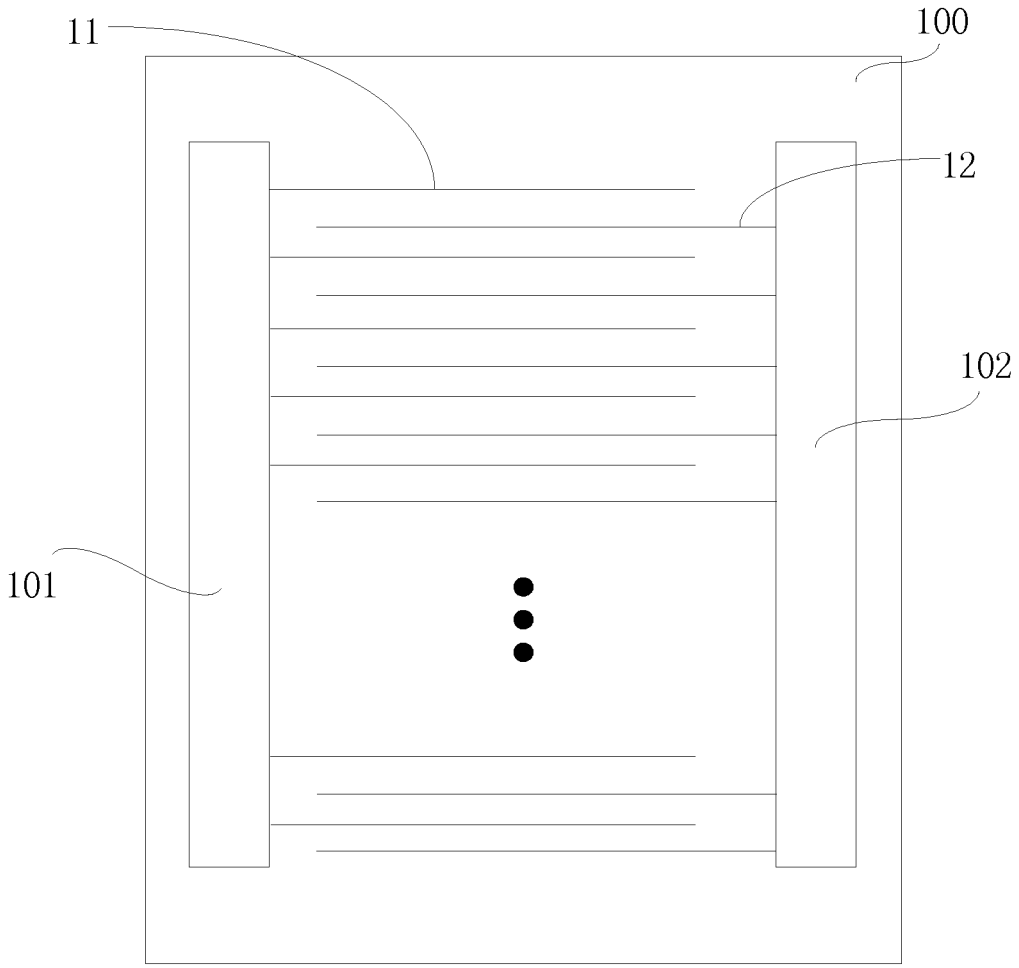
FIG. 1*a* illustrates a simplified schematic diagram of a TFT array substrate according to an embodiment of the invention.

The invention will be described below in further details and more fully with reference to the drawings and particular embodiments. As can be appreciated, the particular embodiments described here are merely intended to explain but not to limit the invention. Moreover it shall be further noted that only those parts relevant to the invention but not all the parts of the invention will be illustrated in the drawings for the sake of the convenient description.

Researchers have identified from their researches that an existing 3D display device includes a 3D display panel, on the surface of which a lens film is adhered, where each pixel is divided into two sub-pixels configured to transmit image data signals of left and right eyes respectively. When the 3D effect need be displayed, an image processing system processes the image data signals so that the image data signals transmitted by the two sub-pixels are different; when the 2D effect need be displayed, the image processing system processes the image data signals so that the image data signals transmitted by the two sub-pixels are the same. Thus it is necessary for the specialized image processing system to process the image data signals so that it may be inconvenient to convert between the 3D display effect and the 2D display effect.

Technical solutions of the invention will be described below by way of particular embodiments, and it shall be noted that:

1. In the course of scanning each frame in a gate drive circuit, it is typically necessary to perform pre-scan resetting and post-scan zeroing on each level of shift register (all the levels of shift registers include all the first to eighth shift registers). The pre-scan resetting refers to pulling the potential at the output terminal of the shift register down to a low potential to thereby zero out the shift register, that is, the pre-scan resetting ensures that the potential at the output terminal of the shift register is the low potential until the level of shift register is scanned, so that the quality of the display image can be ensured. The zeroing refers to pulling the potential at the output terminal of the shift register down to the low potential after the shift register is scanned, that is, after the shift register outputs a gate drive signal, to thereby ensure the shift register to be maintained at the low potential after being scanned so as to avoid interference to the image display and prepare for next scanning.

2. Both a first gate drive circuit and a second gate drive circuit are applicable to forward scanning and backward scanning, and for the sake of the convenient description, both the first gate drive circuit and the second gate drive circuit adopt the forward scanning by way of an example in an embodiment, but the embodiment of the invention will not be limited thereto. In this embodiment, a first transistor T1 to a ninth transistor T9 are NMOS transistors, but the first transistor T1 to the ninth transistor T9 can alternatively be PMOS transistors in another embodiment, and the embodiment of the invention will not be limited thereto.

3. In an embodiment of the invention, a TFT array substrate will not be limited to a TFT array substrate for a Liquid Crystal Display (LCD), a TFT array substrate for an Organic Light Emitting Display (OLED), or a TFT array substrate for an electronic paper or the like. Additionally in the embodiment of the invention, the TFT array substrate will not be limited to an amorphous silicon TFT array substrate, an LTPS TFT array substrate or an oxide TFT array substrate.

4. In an embodiment of the invention, first to eighth start transistors, first to sixteenth clock transistors and first to second pre-scan reset transistors will not be limited to N-type transistors or P-type transistors. In the following respective embodiments and respective drawings, the first to eighth start transistors, the first to sixteenth clock transistors and the first to second pre-scan reset transistors will be described as N-type transistors only by way of an example for the sake of the convenient description.

5. In an embodiment of the invention, the internal circuit structures and drive operating processes of first to eighth shift registers, voltage ranges of first to sixteenth clock signals, voltage ranges of first to eighth start signals, waveforms of the first to sixteenth clock signals, and voltage ranges and waveforms of first to second pre-scan reset signals are all well known in the art, so the repeated description thereof will be omitted in the embodiment.

6. An embodiment of the invention will not limit voltage ranges of a first control line and a second control line as long as such a condition is satisfied that in 2D display, the first control line controls the first start transistor, the third start transistor, the fifth start transistor, the seventh start transistor, the first clock transistor, the third clock transistor, the fifth clock transistor, the seventh clock transistor, the ninth clock transistor, the eleventh clock transistor, the thirteenth clock transistor, the fifteenth clock transistor and the first transistor to be turned off, and the second control line controls the second start transistor, the fourth start transistor, the sixth start transistor, the eighth start transistor, the second clock transistor, the fourth clock transistor, the sixth clock transistor, the eighth clock transistor, the tenth clock transistor, the twelfth clock transistor, the fourteenth clock transistor, the sixteenth clock transistor and the second transistor to be turned on; and in 3D display, the first control line controls the first start transistor, the third start transistor, the fifth start transistor, the seventh start transistor, the first clock transistor, the third clock transistor, the fifth clock transistor, the seventh clock transistor, the ninth clock transistor, the eleventh clock transistor, the thirteenth clock transistor, the fifteenth clock transistor and the first transistor to be turned on, and the second control line controls the second start transistor, the fourth start transistor, the sixth start transistor, the eighth start transistor, the second clock transistor, the fourth clock transistor, the sixth clock transistor, the eighth clock transistor, the tenth clock transistor, the twelfth clock transistor, the fourteenth clock transistor, the sixteenth clock transistor and the second transistor to be turned off.

7. In the following embodiments, the first to eighth start switches, the first to second signal switches, and the first to sixteenth clock switches are typically transistors, where respective gates are connected correspondingly with the first switch line W1 and the second switch line W2, and turned on and off according to the timings of W1 and W2 in FIG. 1*c* to thereby achieve the conversion between 3D and 2D, and this is merely exemplary but not limiting. In practical applications, the first to eighth start switches, the first to second signal switches, and the first to sixteenth clock switches can alternatively be electronic devices with the switch function or the like, and the repeated description thereof will be omitted in the following embodiments.

Figure 1B:
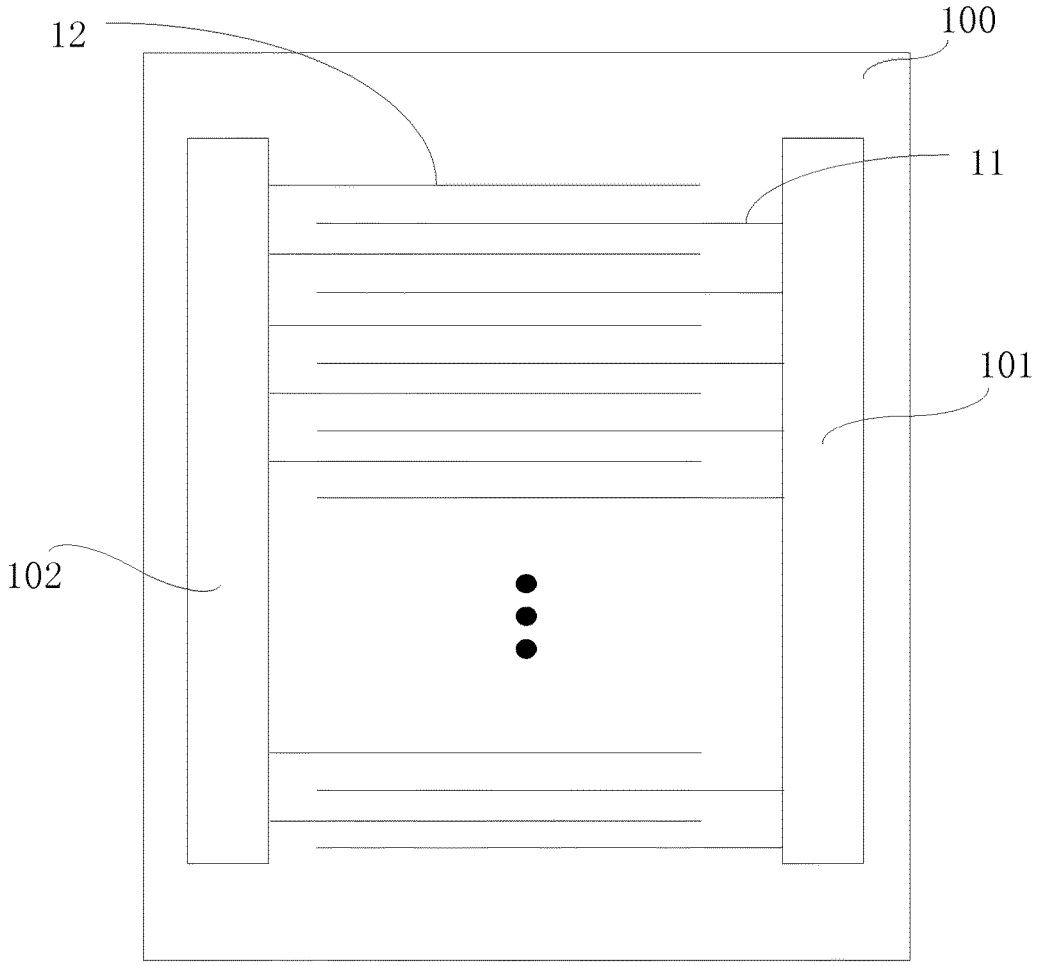
FIG. 1*b* illustrates a schematic structural diagram of another TFT array substrate according to an embodiment of the invention.

Technical solutions of the invention will be described below in connection with the particular embodiments:

As illustrated in FIG. 1*a*, a first embodiment provides a TFT array substrate 100, which includes a plurality of gate lines including a first gate line 11 and a second gate line 12, a first gate drive circuit 101 electrically connected with the first gate line 11, and a second gate drive circuit 102 electrically connected with the second gate line 12. It shall be noted that the relative location of the first gate drive circuit 101 to the second gate drive circuit 102 (the first gate drive circuit 101 is located at the left of the second gate drive circuit 102) illustrated in FIG. 1*a* is merely exemplary but not limiting, and in another embodiment, as illustrated in FIG. 1*b*, the first gate drive circuit 101 is located at the right of the second gate drive circuit 102, so the embodiment of the invention will not be limited in this regard as long as the following condition is satisfied: the first gate drive circuit 101 and the second gate drive circuit 102 are located on two sides of the TFT array substrate 100 respectively, and the first gate drive circuit 101 is electrically connected with the first gate line 11 and the second gate drive circuit 102 is electrically connected with the second gate line 12.

Figure 2:
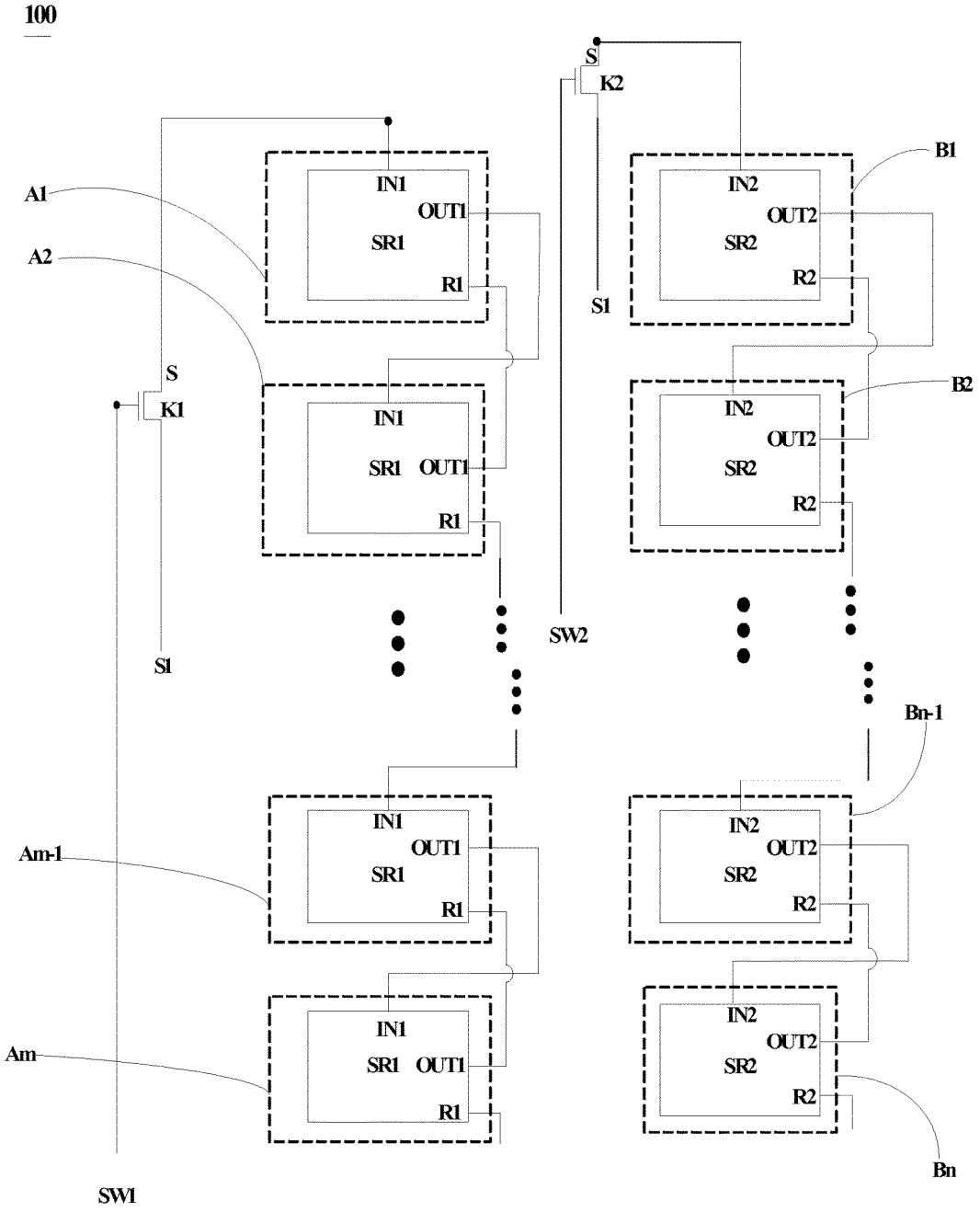
FIG. 2 illustrates a schematic structural diagram of a TFT array substrate according to a first embodiment of the invention.

As illustrated in FIG. 1*a* and FIG. 2, the TFT array substrate 100 further includes a first start signal line S1, and the first gate drive circuit 101 includes m levels of first repeat units A (the m levels of first repeat units A are A1 to Am respectively), where each level of first repeat unit A includes a first shift register SR1 including a first input terminal IN1 and a first output terminal OUT1 connected with the corresponding gate line.

The second gate drive circuit 102 includes n levels of second repeat units B (the n levels of second repeat units B are B1 to Bn respectively), where each level of second repeat unit B includes a second shift register SR2 including a second input terminal IN2 and a second output terminal OUT2 connected with the corresponding gate line.

The TFT array substrate 100 further includes a first start transistor K1 and a second start transistor K2.

The drain of the first start transistor K1 is electrically connected with the first start signal line S1, the source S thereof is electrically connected with the first input terminal IN1 of the first shift register SR1 of the first level of first repeat unit A1, and the gate thereof is electrically connected with a first control line SW1.

Among the second to m-th levels of first repeat units A, the first input terminal IN1 of the first shift register SR1 in the i-th level of first repeat unit A is electrically connected with the first output terminal OUT1 of the first shift register SR1 in the (i−1)-th level of first repeat unit A, for example, the first input terminal IN1 of the first shift register SR1 in the second level of first repeat unit A2 is electrically connected with the first output terminal OUT1 of the first shift register SR1 in the first level of first repeat unit A1.

The drain of the second start transistor K2 is electrically connected with the first start signal line S1, the source S thereof is electrically connected with the second input terminal IN2 of the second shift register SR2 of the first level of second repeat unit B1, and the gate thereof is electrically connected with a second control line SW2.

Among the second to n-th levels of second repeat units B, the second input terminal IN2 of the second shift register SR2 in the i-th level of second repeat unit B is electrically connected with the second output terminal OUT2 of the second shift register SR2 in the (i−1)-th level of second repeat unit B, for example, the second input terminal IN2 of the second shift register SR2 in the second level of second repeat unit B2 is electrically connected with the second output terminal OUT2 of the second shift register SR2 in the first level of second repeat unit B1.

A frame includes a first period of time P1 and a second period of time P2.

In 2D display, during both the first period of time P1 and the second period of time P2, the first control line SW1 controls the first start transistor K1 to be turned on, and the second control line SW2 controls the second start transistor K2 to be turned on; and In 3D display, during the first period of time P1, the first control line SW1 controls the first start transistor K1 to be turned on, and the second control line SW2 controls the second start transistor K2 to be turned off; and during the second period of time P2, the first control line SW1 controls the first start transistor K1 to be turned off, and the second control line SW2 controls the second start transistor K2 to be turned on.

Here all of m, n and i are positive integers, and i is larger than or equal to 2 and smaller than or equal to m and/or n.

The first shift register SR1 further includes a first zeroing terminal R1, and the second shift register SR2 further includes a second zeroing terminal R2.

Among the first to (m−1)-th levels of first repeat units A, the first zeroing terminal R1 of the first shift register SR1 in the k-th level of first repeat unit A is electrically connected with the first output terminal OUT1 of the first shift register SR1 in the (k+1)-th level of first repeat unit A, for example, the first zeroing terminal R1 of the first shift register SR1 in the first level of first repeat unit A1 is electrically connected with the first output terminal OUT1 of the first shift register SR1 in the second level of first repeat unit A2; and Among the first to (n−1)-th levels of second repeat units B, the second zeroing terminal R2 of the second shift register SR2 in the k-th level of second repeat unit B is electrically connected with the second output terminal OUT2 of the second shift register SR2 in the (k+1)-th level of second repeat unit B, for example, the second zeroing terminal R2 of the second shift register SR2 in the first level of second repeat unit B1 is electrically connected with the second output terminal OUT2 of the second shift register SR2 in the second level of second repeat unit B2, where K is a positive integer, and $1 \ll k \ll m-1$ and $1 \ll k \ll n-1$.

With the TFT array substrate according to the embodiment of the invention, in 2D display, during the first period of time and the second period of time, the first control line controls the first start transistor to be turned on, and the second control line controls the second start transistor to be turned on; and in 3D display, during the first period of time, the first control line controls the first start transistor to be turned on, and the second control line controls the second start transistor to be turned off, and during the second period of time, the first control line controls the first start transistor to be turned off, and the second control line controls the second start transistor to be turned on, so that the convenient and rapid conversion between the 2D display effect and the 3D display effect of the display device can be achieved.

Figure 1C:
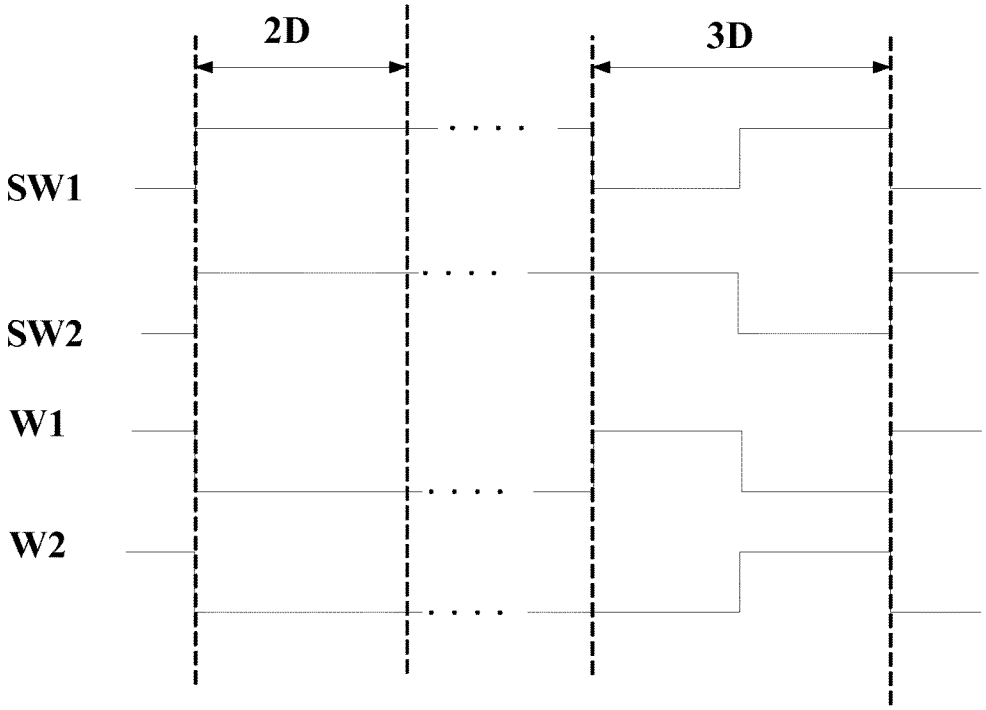
FIG. 1*c* illustrates a waveform diagram of a first control signal, a second control signal, a first switch signal and a second switch signal respectively in 3D and 2D display according to an embodiment of the invention.
Figure 3:
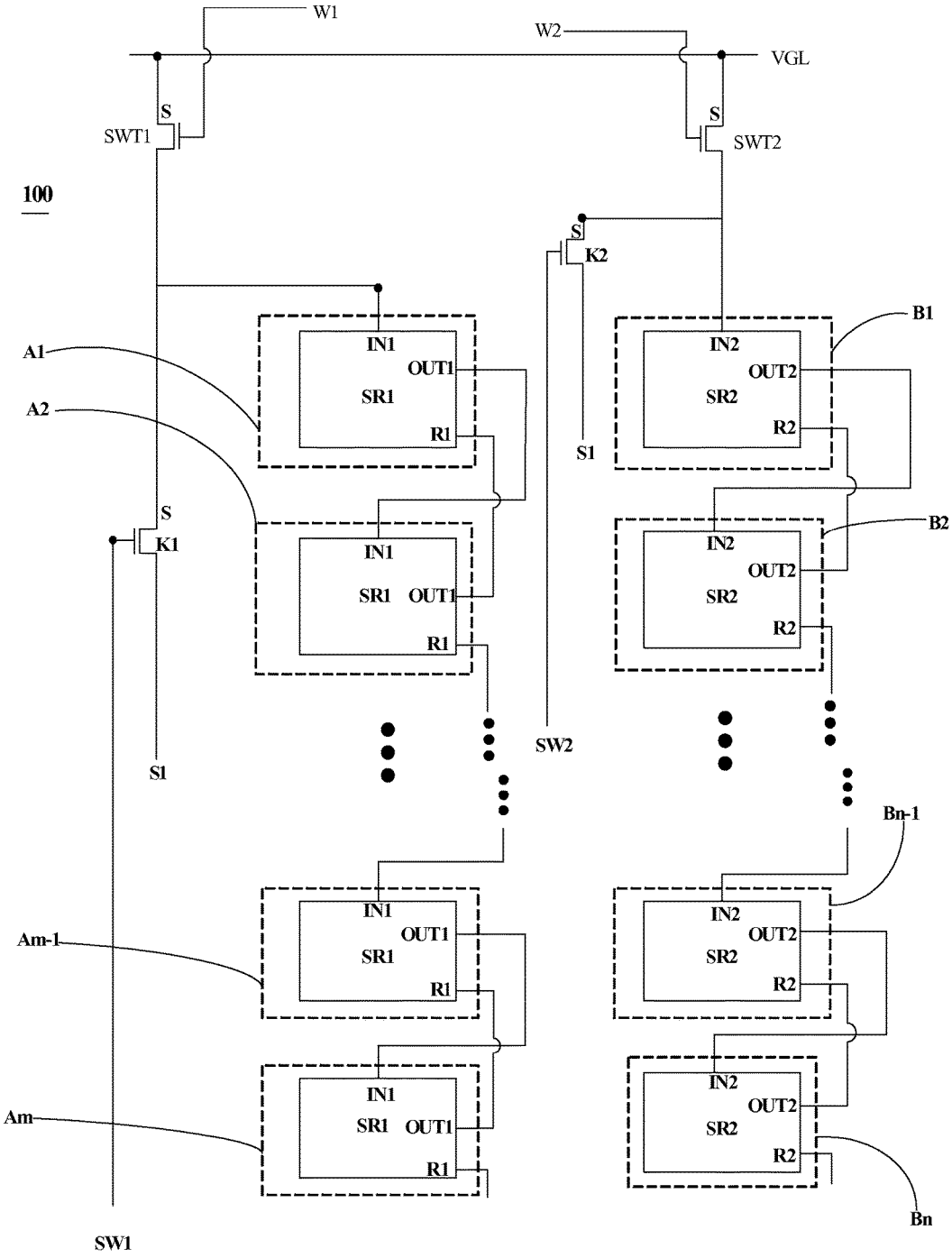
FIG. 3 illustrates a schematic structural diagram of a TFT array substrate according to a second embodiment of the invention.

The invention further provides a second embodiment as illustrated in FIG. 1*a*, FIG. 1*c* and FIG. 3, and the same points of the second embodiment as the first embodiment will not be described again. On the basis of the first embodiment, the TFT array substrate 100 according to the second embodiment further includes a low level signal line VGL, a first start switch SWT1 and a second start switch SWT2.

The first input terminal IN1 of the first shift register SR1 in the first level of first repeat unit A1 is further electrically connected with the low level signal line VGL through the first start switch SWT1; and The second input terminal IN2 of the second shift register SR2 in the first level of second repeat unit B1 is further electrically connected with the low level signal line VGL through the second start switch SWT2.

In 2D display, during the first period of time P1 and the second period of time P2, the first start switch SWT1 and the second start switch SWT2 are turned off; and In 3D display, during the first period of time P1, the first start switch SWT1 is turned off, and the second start switch SWT2 is turned on; and during the second period of time P2, the first start switch SWT1 is turned on, and the second start switch SWT2 is turned off.

With the TFT array substrate, the display panel and the display device according to the embodiments of the invention, in 2D display, during the first period of time and the second period of time, the first control line controls the first start transistor to be turned on, and the second control line controls the second start transistor to be turned on; and in 3D display, during the first period of time, the first control line controls the first start transistor to be turned on, and the second control line controls the second start transistor to be turned off, and during the second period of time, the first control line controls the first start transistor to be turned off, and the second control line controls the second start transistor to be turned on, so that the convenient and rapid conversion between the 2D display effect and the 3D display effect of the display device can be achieved.

In 2D display, during the first period of time P1 and the second period of time P2, the first start switch SWT1 and the second start switch SWT2 are turned off so that the adverse influence due to leakage current of the respective transistors can be prevented to improve the performance of the TFT array substrate.

In 3D display, during the first period of time P1, the first start switch SWT1 is turned off and the second start switch SWT2 is turned on so that the adverse influence due to leakage current of the respective transistors connected with the first start switch SWT1 can be prevented to improve the performance of the TFT array substrate; and during the second period of time P2, the first start switch SWT1 is turned on and the second start switch SWT2 is turned off so that the adverse influence due to leakage current of the respective transistors connected with the second start switch SWT2 can be prevented to improve the performance of the TFT array substrate.

Figure 4:
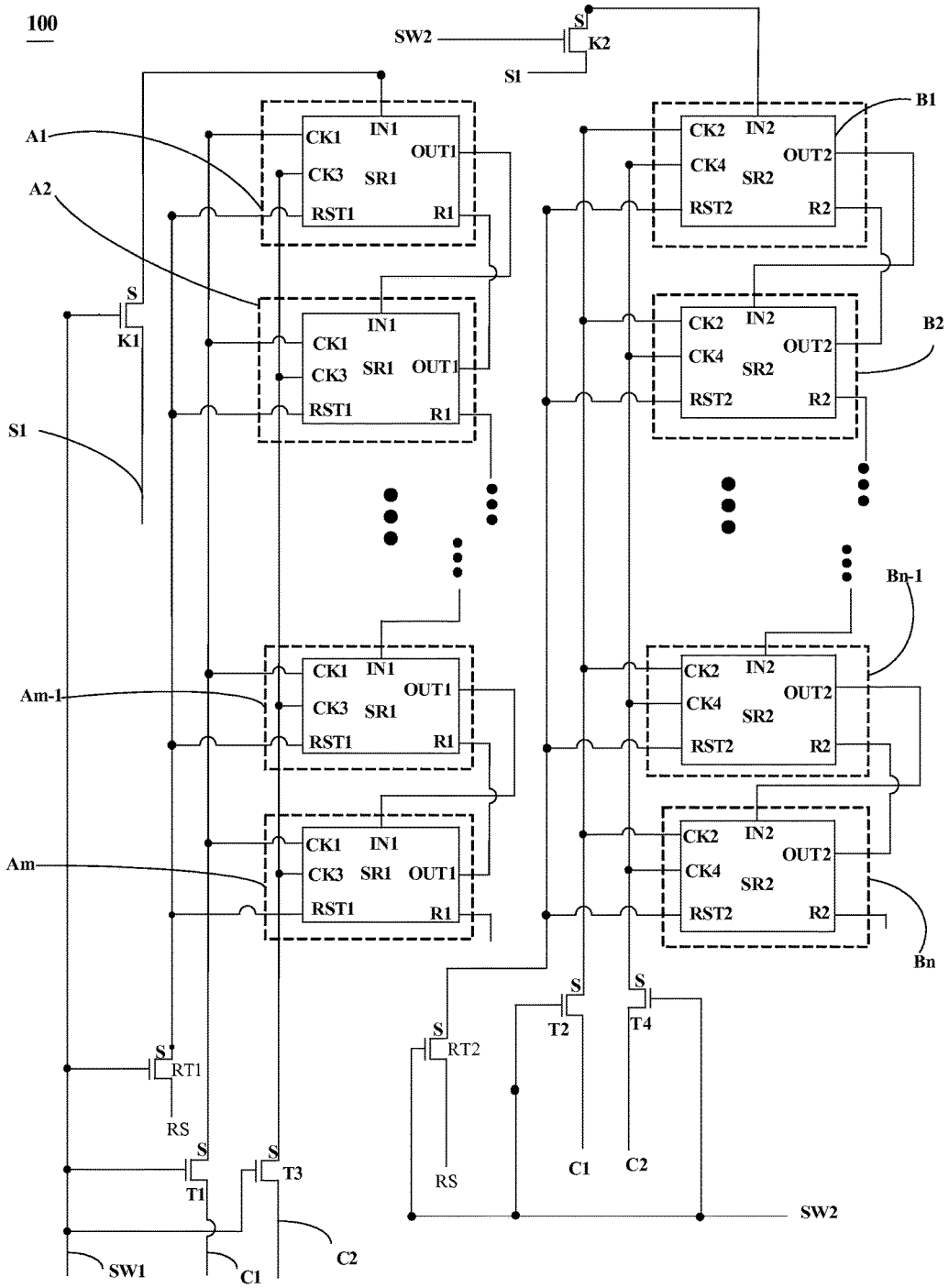
FIG. 4 illustrates a schematic structural diagram of a TFT array substrate according to a third embodiment of the invention.

The invention further provides a third embodiment as illustrated in FIG. 1*a*, FIG. 1*c* and FIG. 4, and the same points of the third embodiment as the first embodiment will not be described again. On the basis of the first embodiment, the TFT array substrate 100 according to the third embodiment further includes a first clock signal line C1, a first clock transistor T1 and a second clock transistor T2, a second clock signal line C2, a third clock transistor T3 and a fourth clock transistor T4; the first shift register SR1 further includes a first clock signal terminal CK1 and a third clock signal terminal CK3; and the second shift register SR2 further includes a second clock signal terminal CK2 and a fourth clock signal terminal CK4.

In each level of first repeat unit A, the drain of the first clock transistor T1 is electrically connected with the first clock signal line C1, the gate thereof is electrically connected with the first control line SW1, and the source S thereof is electrically connected with the first clock signal terminal CK1; and the drain of the third clock transistor T3 is electrically connected with the second clock signal line C2, the gate thereof is electrically connected with the first control line SW1, and the source S thereof is electrically connected with the third clock signal terminal CK3; and In each level of second repeat unit B, the drain of the second clock transistor T2 is electrically connected with the first clock signal line C1, the gate thereof is electrically connected with the second control line SW2, and the source S thereof is electrically connected with the second clock signal terminal CK2; and the drain of the fourth clock transistor T4 is electrically connected with the second clock signal line C2, the gate thereof is electrically connected with the second control line SW2, and the source S thereof is electrically connected with the fourth clock signal terminal CK4.

In 2D display, during the first period of time P1 and the second period of time P2, the first control line SW1 controls the first clock transistor T1 and the third clock transistor T3 to be turned on, and the second control line SW2 controls the second clock transistor T2 and the fourth clock transistor T4 to be turned on; and In 3D display, during the first period of time P1, the first control line SW1 controls the first clock transistor T1 and the third clock transistor T3 to be turned on, and the second control line SW2 controls the second clock transistor T2 and the fourth clock transistor T4 to be turned off; and during the second period of time P2, the first control line SW1 controls the first clock transistor T1 and the third clock transistor T3 to be turned off, and the second control line SW2 controls the second clock transistor T2 and the fourth clock transistor T4 to be turned on.

Furthermore the TFT array substrate 100 further includes a first signal line RS, a first transistor RT1 and a second transistor RT2; the first shift register SR1 further includes a first terminal RST1; and the second shift register SR2 further includes a second terminal RST2.

In each level of first repeat unit A, the drain of the first transistor RT1 is electrically connected with the first signal line RS, the gate thereof is electrically connected with the first control line SW1, and the source S thereof is electrically connected with the first terminal RST1; and In each level of second repeat unit B, the drain of the second transistor RT2 is electrically connected with the first signal line RS, the gate thereof is electrically connected with the second control line SW2, and the source S thereof is electrically connected with the second terminal RST2.

In 2D display, during the first period of time P1 and the second period of time P2, the first control line SW1 controls the first transistor RT1 to be turned on, and the second control line SW2 controls the second transistor RT2 to be turned on; and In 3D display, during the first period of time P1, the first control line SW1 controls the first transistor RT1 to be turned on, and the second control line SW2 controls the second transistor RT2 to be turned off; and during the second period of time P2, the first control line SW1 controls the first transistor RT1 to be turned off, and the second control line SW2 controls the second transistor RT2 to be turned on.

It shall be noted that the first signal line RS can output a pre-scan rest signal; or the first signal line RS can output a constant high level signal; or the first signal line RS can output a constant low level signal; or the first signal line RS can output a forward scan signal; or the first signal line RS can output a backward scan signal.

Figure 5:
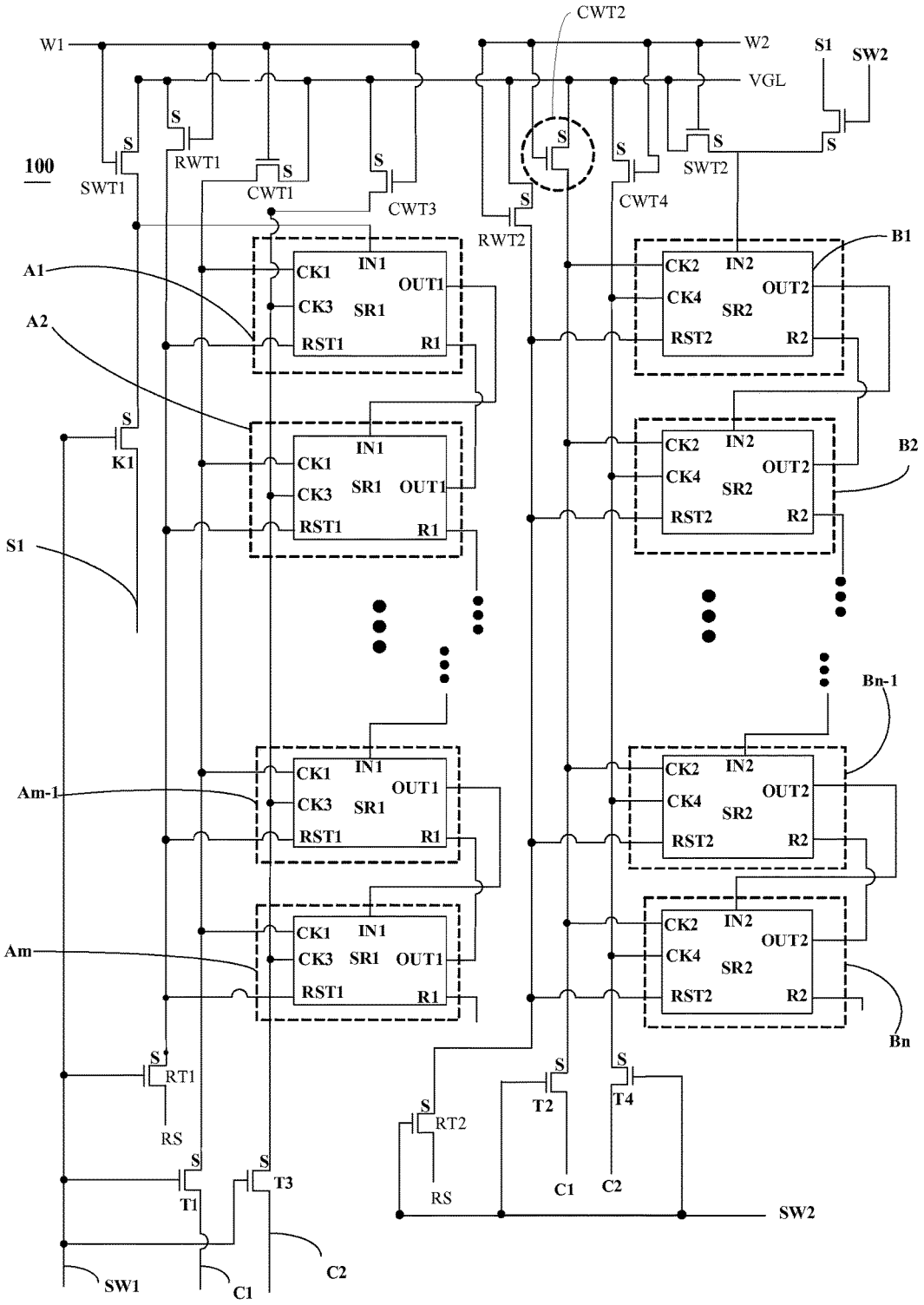
FIG. 5 illustrates a schematic structural diagram of a TFT array substrate according to a fourth embodiment of the invention.

The invention further provides a fourth embodiment as illustrated in FIG. 1*a*, FIG. 1*c* and FIG. 5, and the same points of the fourth embodiment as the third embodiment will not be described again. On the basis of the second embodiment and the third embodiment, the TFT array substrate 100 according to the fourth embodiment further includes a low level signal line VGL, a first clock switch CWT1, a second clock switch CWT2, a third clock switch CWT3 and a fourth clock switch CWT4.

The first clock signal terminal CK1 of the first shift register SR1 in the first level of first repeat unit A1 is further electrically connected with the low level signal line VGL through the first clock switch CWT1, and the third clock signal terminal CK3 of the first shift register SR1 in the first level of first repeat unit A1 is further electrically connected with the low level signal line VGL through the third clock switch CWT3.

The second clock signal terminal CK2 of the second shift register SR2 in the first level of second repeat unit B1 is further electrically connected with the low level signal line VGL through the second clock switch CWT2, and the fourth clock signal terminal CK4 of the second shift register SR2 in the first level of second repeat unit B1 is further electrically connected with the low level signal line VGL through the fourth clock switch CWT4.

In 2D display, during the first period of time P1 and the second period of time P2, the first clock switch CWT1, the second clock switch CWT2, and the third clock switch CWT3 and the fourth clock switch CWT4 are turned off; and In 3D display, during the first period of time P1, the first clock switch CWT1 and the third clock switch CWT3 are turned off, and the second clock switch CWT2 and the fourth clock switch CWT4 are turned on; and during the second period of time P2, the first clock switch CWT1 and the third clock switch CWT3 are turned on, and the second clock switch CWT2 and the fourth clock switch CWT4 are turned off.

Furthermore the TFT array substrate 100 further includes a low level signal line VGL, a first signal switch RWT1 and a second signal switch RWT2.

The first terminal RST1 of the first shift register SR1 in the first level of first repeat unit A1 is further electrically connected with the low level signal line VGL through the first signal switch RWT1; and The second terminal RST2 of the second shift register SR2 in the first level of second repeat unit B1 is further electrically connected with the low level signal line VGL through the second signal switch RWT2.

In 2D display, during the first period of time P1 and the second period of time P2, the first signal switch RWT1 and the second signal switch RWT2 are turned off; and In 3D display, during the first period of time P1, the first signal switch RWT1 is turned off, and the second signal switch RWT2 is turned on; and during the second period of time P2, the first signal switch RWT1 is turned on, and the second signal switch RWT2 is turned off.

In 2D display, during the first period of time P1 and the second period of time P2, the first signal switch RWT1 and the second signal switch RWT2 are turned off so that the adverse influence due to leakage current of the respective transistors can be prevented to improve the performance of the TFT array substrate.

In 3D display, during the first period of time P1, the first signal switch RWT1 is turned off and the second signal switch RWT2 is turned on so that the adverse influence due to leakage current of the respective transistors connected with the first signal switch RWT1 can be prevented to improve the performance of the TFT array substrate; and during the second period of time P2, the first signal switch RWT1 is turned on and the second signal switch RWT2 is turned off so that the adverse influence due to leakage current of the respective transistors connected with the second signal switch RWT2 can be prevented to improve the performance of the TFT array substrate.

Figure 6:
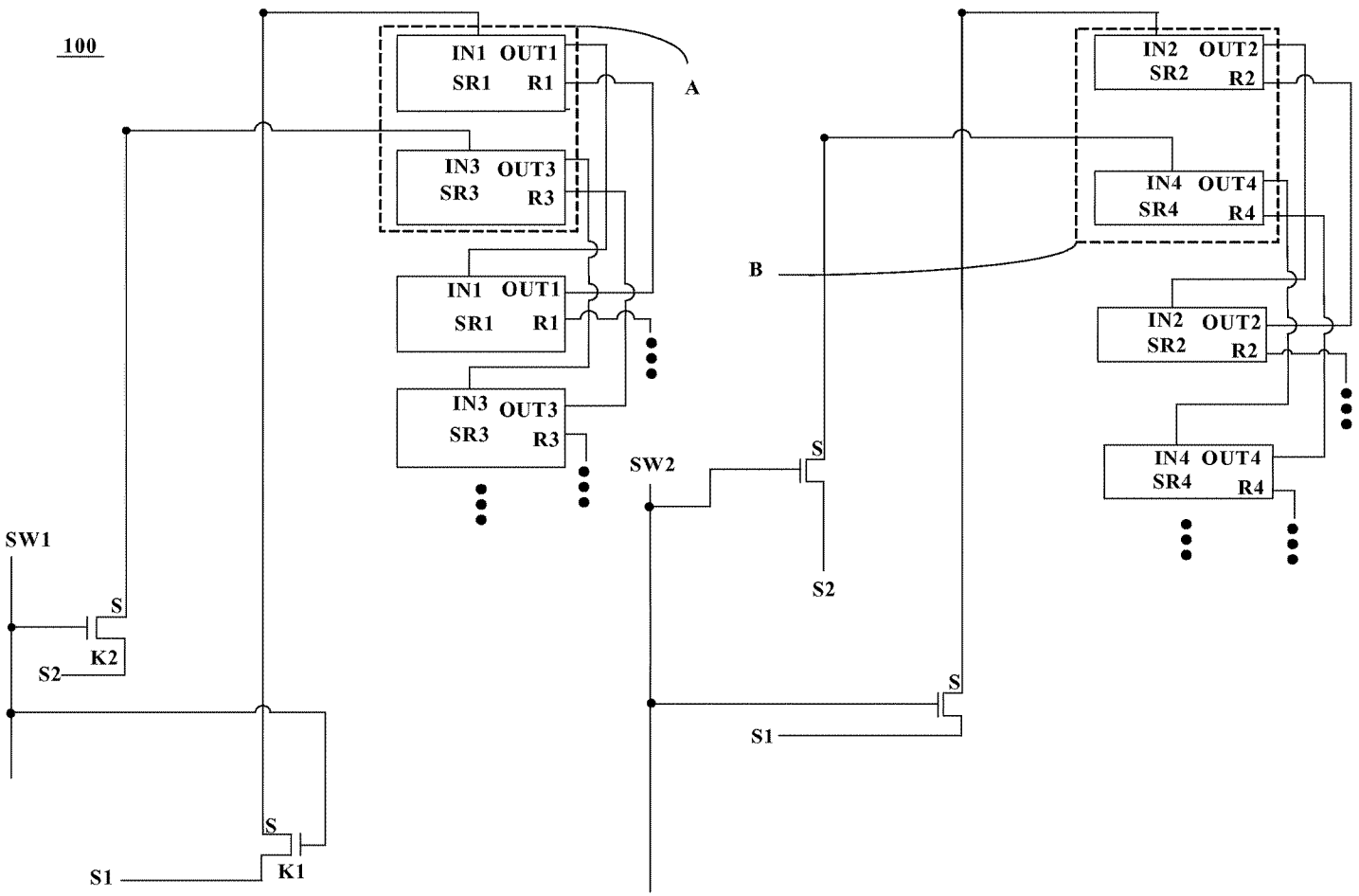
FIG. 6 illustrates a schematic structural diagram of a TFT array substrate according to a fifth embodiment of the invention.

The invention further provides a fifth embodiment as illustrated in FIG. 1*a*, FIG. 1*c* and FIG. 6, and the same points of the fifth embodiment as the first embodiment will not be described again. On the basis of the third embodiment, in the TFT array substrate 100 according to the fifth embodiment, Each level of first repeat unit A further includes a third shift register SR3 including a third input terminal IN3 and a third output terminal OUT3 connected with the corresponding gate line; and Each level of second repeat unit B further includes a fourth shift register SR4 including a fourth input terminal IN4 and a fourth output terminal OUT4 connected with the corresponding gate line.

The TFT array substrate 100 further includes a third start transistor K3 and a fourth start transistor K4.

The drain of the third start transistor K3 is electrically connected with the second start signal line S2, the source S thereof is electrically connected with the third input terminal IN3 of the third shift register SR3 in the first level of first repeat unit A1, and the gate thereof is electrically connected with the first control line SW1;

Among the second to m-th levels of first repeat units A, the first input terminal IN1 of the first shift register SR1 in the i-th level of first repeat unit A is electrically connected with the first output terminal OUT1 of the first shift register SR1 in the (i−1)-th level of first repeat unit A, and the third input terminal IN3 of the third shift register SR3 in the i-th level of first repeat unit A is electrically connected with the third output terminal OUT3 of the third shift register SR3 in the (i−1)-th level of first repeat unit A, for example, the first input terminal IN1 of the first shift register SR1 in the second level of first repeat unit A2 is electrically connected with the first output terminal OUT1 of the first shift register SR1 in the first level of first repeat unit A1, and the third input terminal IN3 of the third shift register SR3 in the second level of first repeat unit A2 is electrically connected with the third output terminal OUT3 of the third shift register SR3 in the first level of first repeat unit A1; and The drain of the fourth start transistor K4 is electrically connected with the second start signal line S2, the source S thereof is electrically connected with the fourth input terminal IN4 of the fourth shift register SR4 of the first level of second repeat unit B1, and the gate thereof is electrically connected with the second control line SW2;

Among the second to n-th levels of second repeat units B, the second input terminal IN2 of the second shift register SR2 in the i-th level of second repeat unit B is electrically connected with the second output terminal OUT2 of the second shift register SR2 in the (i−1)-th level of second repeat unit B, and the fourth input terminal IN4 of the fourth shift register SR4 in the i-th level of second repeat unit B is electrically connected with the fourth output terminal OUT4 of the fourth shift register SR4 in the (i−1)-th level of second repeat unit B, for example, the second input terminal IN2 of the second shift register SR2 in the second level of second repeat unit B2 is electrically connected with the second output terminal OUT2 of the second shift register SR2 in the first level of second repeat unit B1, and the fourth input terminal IN4 of the fourth shift register SR4 in the second level of second repeat unit B2 is electrically connected with the fourth output terminal OUT4 of the fourth shift register SR4 in the first level of second repeat unit B1.

In 2D display, during the first period of time P1 and the second period of time P2, the first control line SW1 controls the third start transistor K3 to be turned on, and the second control line SW2 controls the fourth start transistor K4 to be turned on; and In 3D display, during the first period of time P1, the first control line SW1 controls the third start transistor K3 to be turned on, and the second control line SW2 controls the fourth start transistor K4 to be turned off; and during the second period of time P2, the first control line SW1 controls the third start transistor K3 to be turned off, and the second control line SW2 controls the fourth start transistor K4 to be turned on.

Furthermore the first shift register SR1 further includes a first zeroing terminal R1, the second shift register SR2 further includes a second zeroing terminal R2, the third shift register SR3 further includes a third zeroing terminal R3, and the fourth shift register SR4 further includes a fourth zeroing terminal R4.

Among the first to (m−1)-th levels of first repeat units A, the first zeroing terminal R1 of the first shift register SR1 in the k-th level of first repeat unit A is electrically connected with the first output terminal OUT1 of the first shift register SR1 in the (k+1)-th level of first repeat unit A, and the third zeroing terminal R3 of the third shift register SR3 in the k-th level of first repeat unit A is electrically connected with the third output terminal OUT3 of the third shift register SR3 in the (k+1)-th level of first repeat unit A, for example, the first zeroing terminal R1 of the first shift register SR1 in the first level of first repeat unit A1 is electrically connected with the first output terminal OUT1 of the first shift register SR1 in the second level of first repeat unit A2, and the third zeroing terminal R3 of the third shift register SR3 in the first level of first repeat unit A1 is electrically connected with the third output terminal OUT3 of the third shift register SR3 in the second level of first repeat unit A2; and Among the first to (n−1)-th levels of second repeat units B, the second zeroing terminal R2 of the second shift register SR2 in the k-th level of second repeat unit B is electrically connected with the second output terminal OUT2 of the second shift register SR2 in the (k+1)-th level of second repeat unit B, and the fourth zeroing terminal R4 of the fourth shift register SR4 in the k-th level of second repeat unit B is electrically connected with the fourth output terminal OUT4 of the fourth shift register SR4 in the (k+1)-th level of second repeat unit B, for example, the second zeroing terminal R2 of the second shift register SR2 in the first level of second repeat unit B1 is electrically connected with the second output terminal OUT2 of the second shift register SR2 in the second level of second repeat unit B2, and the fourth zeroing terminal R4 of the fourth shift register SR4 in the first level of second repeat unit B1 is electrically connected with the fourth output terminal OUT4 of the fourth shift register SR4 in the second level of second repeat unit B2, where K is a positive integer, and $1<<k<<m-1$ and $1<<k<<n-1$.

Figure 7:
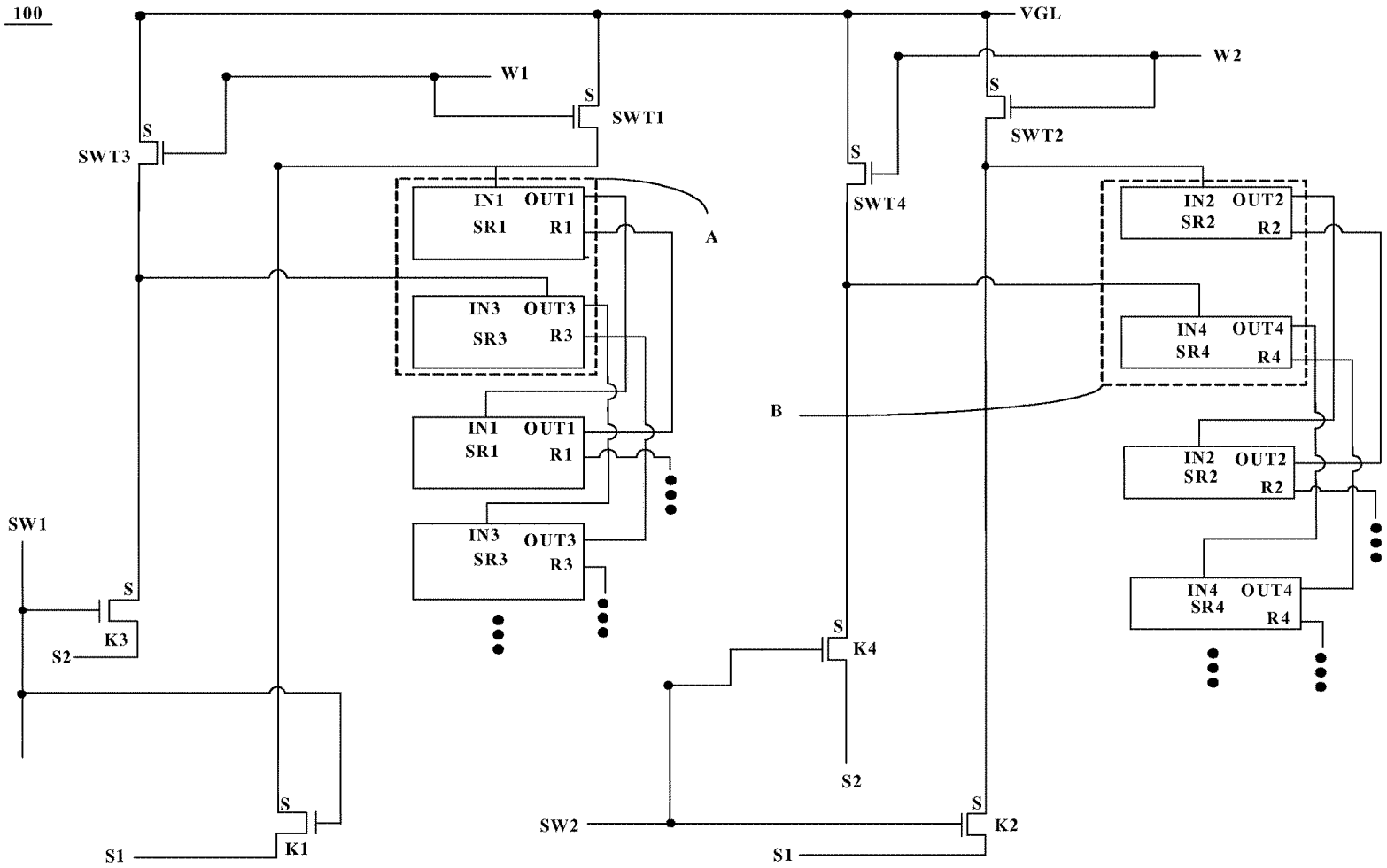
FIG. 7 illustrates a schematic structural diagram of a TFT array substrate according to a sixth embodiment of the invention.

The invention further provides a sixth embodiment as illustrated in FIG. 1*a*, FIG. 1*c* and FIG. 7, and the same points of the sixth embodiment as the fifth embodiment will not be described again. On the basis of the fifth embodiment, the TFT array substrate 100 according to the sixth embodiment further includes a low level signal line VGL, a first start switch SWT1, a second start switch SWT2, a third start switch SWT3 and a fourth start switch SWT4.

In the first level of first repeat unit A1, the first input terminal IN1 of the first shift register SR1 is further electrically connected with the low level signal line VGL through the first start switch SWT1, and the third input terminal IN3 of the third shift register SR3 is further electrically connected with the low level signal line VGL through the third start switch SWT3; and In the first level of second repeat unit B1, the second input terminal IN2 of the second shift register SR2 is further electrically connected with the low level signal line VGL through the second start switch SWT2, and the fourth input terminal IN4 of the fourth shift register SR4 is further electrically connected with the low level signal line VGL through the fourth start switch SWT4.

In 2D display, during the first period of time P1 and the second period of time P2, the first start switch SWT1, the second start switch SWT2, the third start switch SWT3 and the fourth start switch SWT4 are turned off; and In 3D display, during the first period of time P1, the first start switch SWT1 and the third start switch SWT3 are turned off, and the second start switch SWT2 and the fourth start switch SWT4 are turned on; and during the second period of time P2, the first start switch SWT1 and the third start switch SWT3 are turned on, and the second start switch SWT2 and the fourth start switch SWT4 are turned off.

Figure 8:
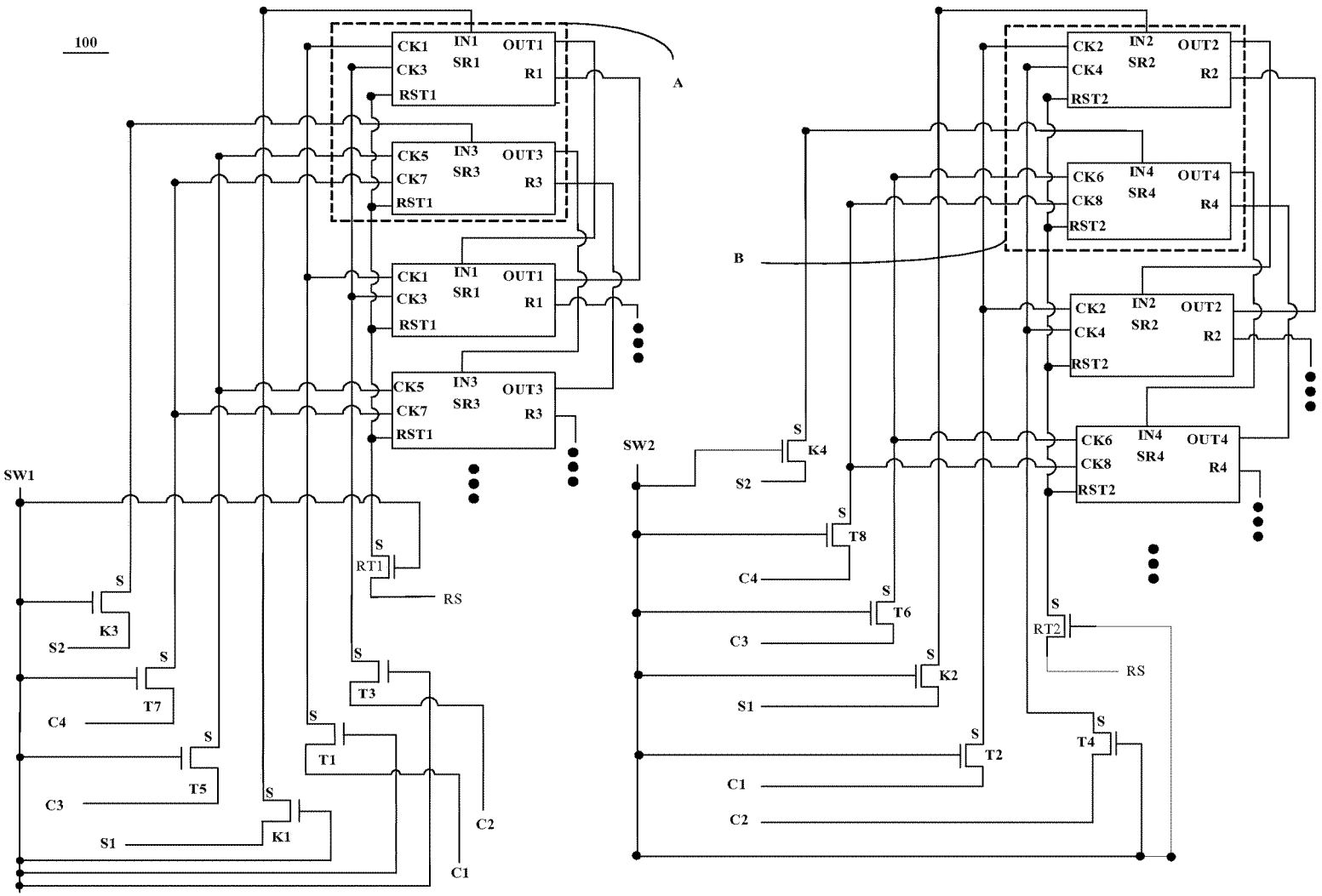
FIG. 8 illustrates a schematic structural diagram of a TFT array substrate according to a seventh embodiment of the invention.

The invention further provides a seventh embodiment as illustrated in FIG. 1*a*, FIG. 1*c* and FIG. 8, and the same points of the seventh embodiment as the fifth embodiment will not be described again. On the basis of the fifth embodiment, the TFT array substrate 100 according to the seventh embodiment further includes a first clock signal line C1, a first clock transistor T1, a second clock transistor T2, a second clock signal line C2, a third clock transistor T3, a fourth clock transistor T4, a third clock signal line C3, a fifth clock transistor T5, a sixth clock transistor T6, a fourth clock signal line C4, a seventh clock transistor T7 and an eighth clock transistor T8; the first shift register SR1 further includes a first clock signal terminal CK1, a third clock signal terminal CK3, a fifth clock signal terminal CK5 and a seventh clock signal terminal CK7; and the second shift register SR2 further includes a second clock signal terminal CK2, a fourth clock signal terminal CK4, a sixth clock signal terminal CK6 and an eighth clock signal terminal CK8.

In each level of first repeat unit A, the drain of the first clock transistor T1 is electrically connected with the first clock signal line C1, the gate thereof is electrically connected with the first control line SW1, and the source S thereof is electrically connected with the first clock signal terminal CK1; the drain of the third clock transistor T3 is electrically connected with the second clock signal line C2, the gate thereof is electrically connected with the first control line SW1, and the source S thereof is electrically connected with the third clock signal terminal CK3; the drain of the fifth clock transistor T5 is electrically connected with the third clock signal line C3, the gate thereof is electrically connected with the first control line SW1, and the source S thereof is electrically connected with the fifth clock signal terminal CK5; and the drain of the seventh clock transistor T7 is electrically connected with the fourth clock signal line C4, the gate thereof is electrically connected with the first control line SW1, and the source S thereof is electrically connected with the seventh clock signal terminal CK7; and In each level of second repeat unit B, the drain of the second clock transistor T2 is electrically connected with the first clock signal line C1, the gate thereof is electrically connected with the second control line SW2, and the source S thereof is electrically connected with the second clock signal terminal CK2; the drain of the fourth clock transistor T4 is electrically connected with the second clock signal line C2, the gate thereof is electrically connected with the second control line SW2, and the source S thereof is electrically connected with the fourth clock signal terminal CK4; the drain of the sixth clock transistor T6 is electrically connected with the third clock signal line C3, the gate thereof is electrically connected with the second control line SW2, and the source S thereof is electrically connected with the sixth clock signal terminal CK6; and the drain of the eighth clock transistor T8 is electrically connected with the fourth clock signal line C4, the gate thereof is electrically connected with the second control line SW2, and the source S thereof is electrically connected with the eighth clock signal terminal CK8.

In 2D display, during the first period of time P1 and the second period of time P2, the first control line SW1 controls the first clock transistor T1, the third clock transistor T3, the fifth clock transistor T5 and the seventh clock transistor T7 to be turned on, and the second control line SW2 controls the second clock transistor T2, the fourth clock transistor T4, the sixth clock transistor T6 and the eighth clock transistor T8 to be turned on; and In 3D display, during the first period of time P1, the first control line SW1 controls the first clock transistor T1, the third clock transistor T3, the fifth clock transistor T5 and the seventh clock transistor T7 to be turned on, and the second control line SW2 controls the second clock transistor T2, the fourth clock transistor T4, the sixth clock transistor T6 and the eighth clock transistor T8 to be turned off; and during the second period of time P2, the first control line SW1 controls the first clock transistor T1, the third clock transistor T3, the fifth clock transistor T5 and the seventh clock transistor T7 to be turned off, and the second control line SW2 controls the second clock transistor T2, the fourth clock transistor T4, the sixth clock transistor T6 and the eighth clock transistor T8 to be turned on.

Furthermore the TFT array substrate 100 further includes a first signal line RS, a first transistor RT1 and a second transistor RT2; each of the first shift register SR1 and the third shift register SR3 further includes a first terminal RST1; and each of the second shift register SR2 and the fourth shift register SR4 further includes a second terminal RST2.

In each level of first repeat unit A, the drain of the first transistor RT1 is electrically connected with the first signal line RS, the gate thereof is electrically connected with the first control line SW1, and the source S thereof is electrically connected with the first terminal RST1; and In each level of second repeat unit B, the drain of the second transistor RT2 is electrically connected with the first signal line RS, the gate thereof is electrically connected with the second control line SW2, and the source S thereof is electrically connected with the second terminal RST2.

In 2D display, during the first period of time P1 and the second period of time P2, the first control line SW1 controls the first transistor RT1 to be turned on, and the second control line SW2 controls the second transistor RT2 to be turned on; and In 3D display, during the first period of time P1, the first control line SW1 controls the first transistor RT1 to be turned on, and the second control line SW2 controls the second transistor RT2 to be turned off; and during the second period of time P2, the first control line SW1 controls the first transistor RT1 to be turned off, and the second control line SW2 controls the second transistor RT2 to be turned on.

It shall be noted that the first signal line RS can output a pre-scan rest signal; or the first signal line RS can output a constant high level signal; or the first signal line RS can output a constant low level signal; or the first signal line RS can output a forward scan signal; or the first signal line RS can output a backward scan signal.

Figure 9:
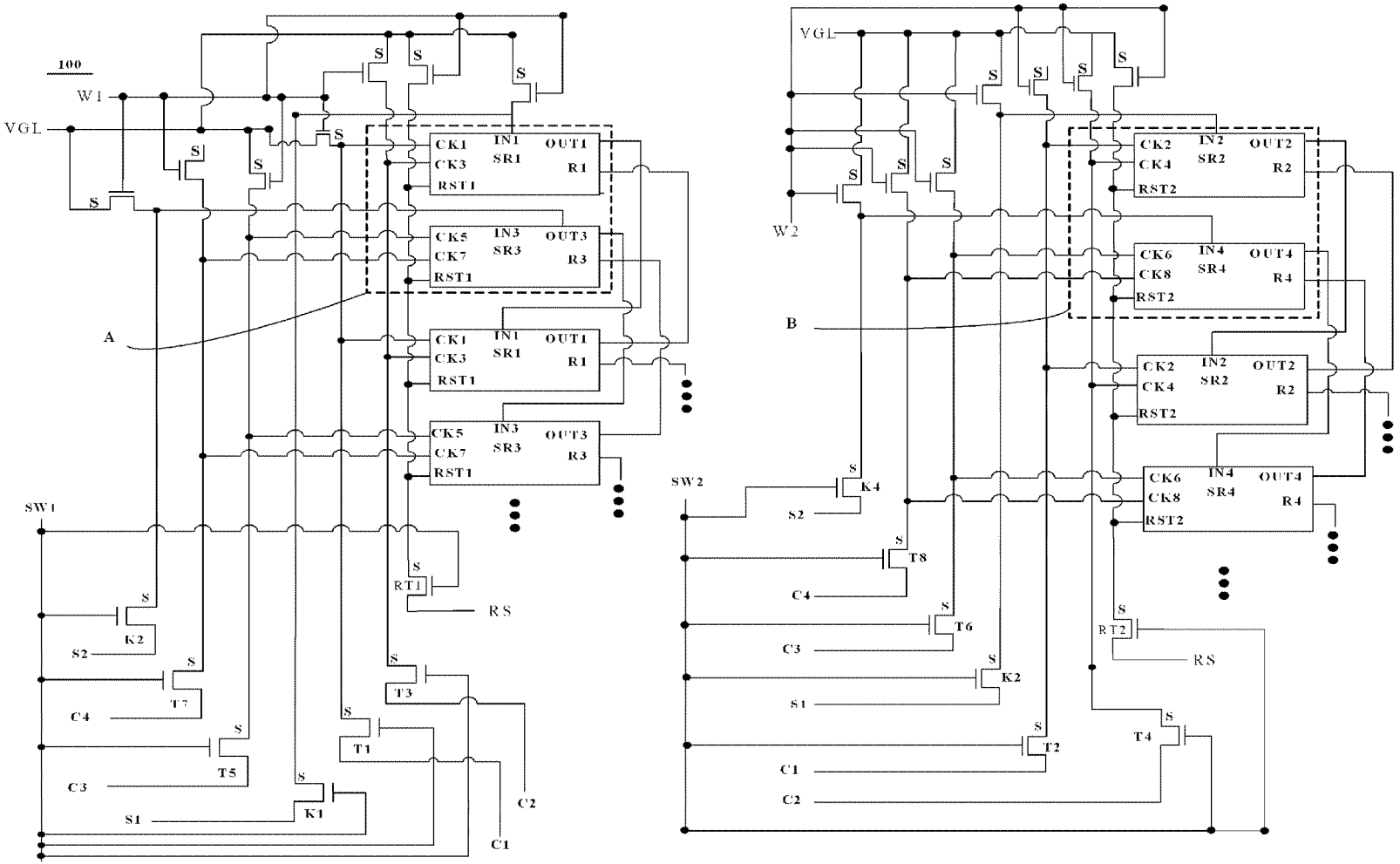
FIG. 9 illustrates a schematic structural diagram of a TFT array substrate according to an eighth embodiment of the invention.
Figure 10:
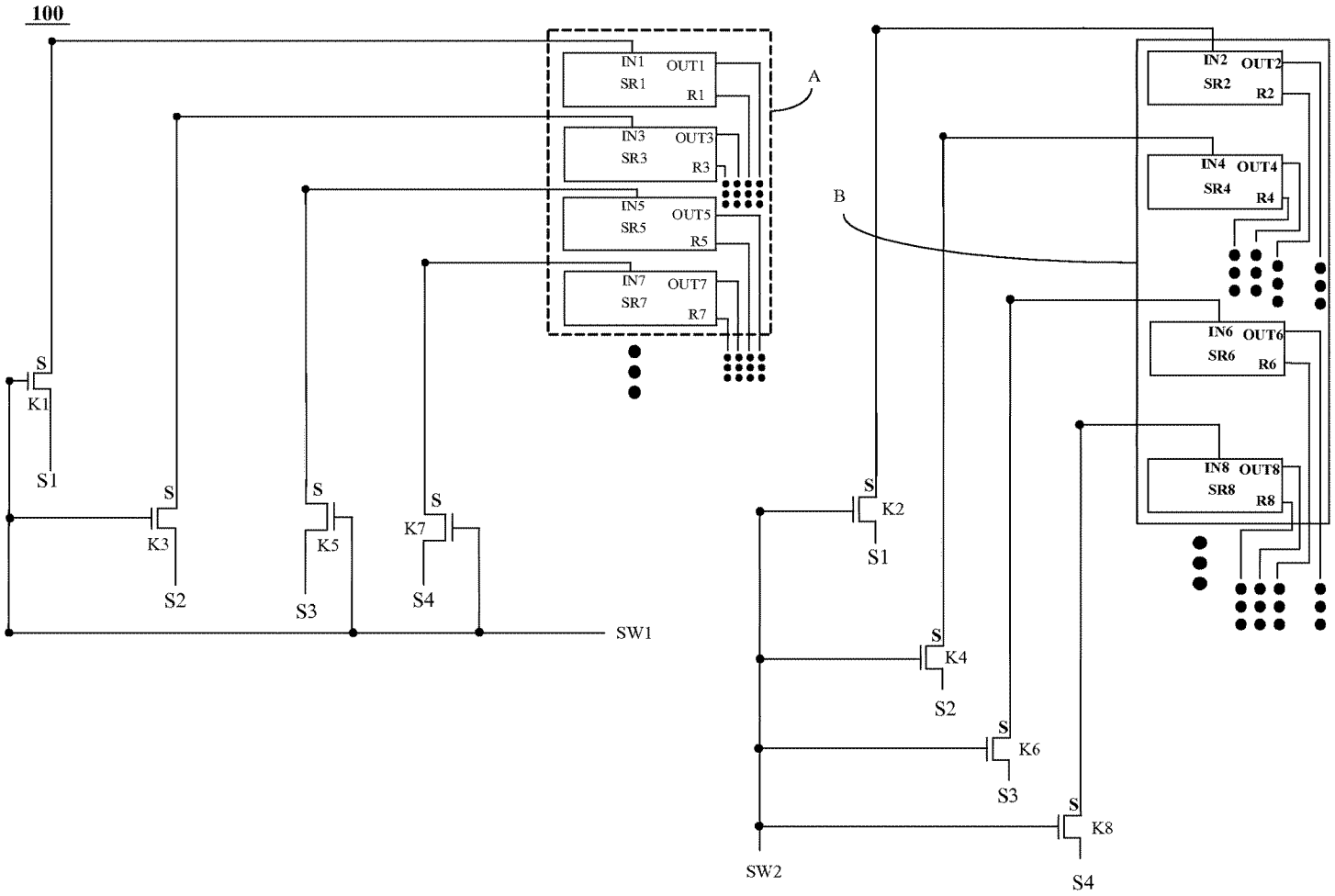
FIG. 10 illustrates a schematic structural diagram of a TFT array substrate according to a ninth embodiment of the invention.
Figure 11:
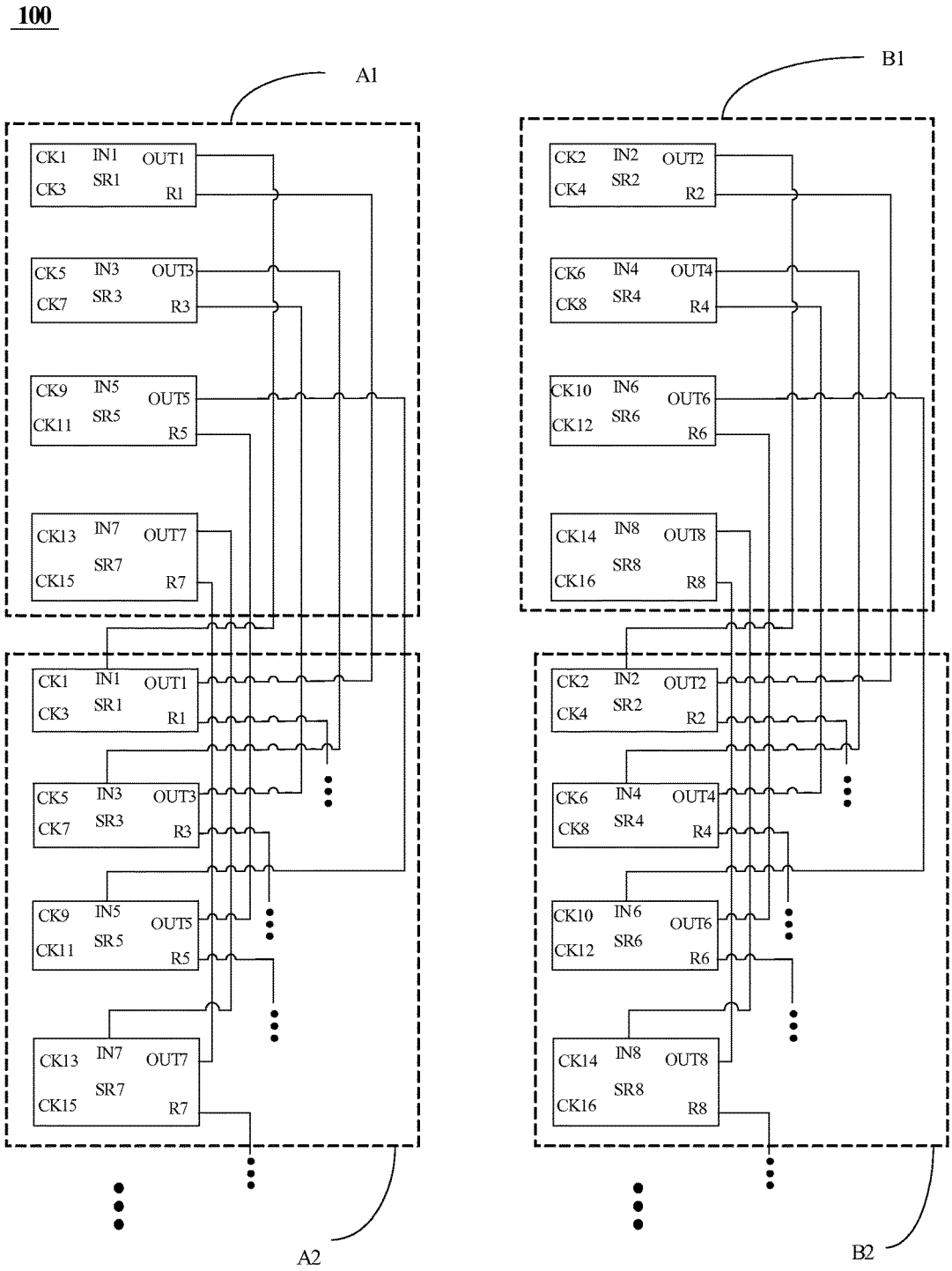
FIG. 11 illustrates a schematic structural diagram of a part of the TFT array substrate according to the ninth embodiment of the invention.

The invention further provides an eighth embodiment as illustrated in FIG. 1*a*, FIG. 1*c* and FIG. 9, and the same points of the eighth embodiment as the seventh embodiment will not be described again. On the basis of the seventh embodiment, the TFT array substrate 100 according to the eighth embodiment further includes: a low level signal line VGL, a first clock switch CWT1, a second clock switch CWT2, a third clock switch CWT3, a fourth clock switch CWT4, a fifth clock switch CWT5, a sixth clock switch CWT6, a seventh clock switch CWT7 and an eighth clock switch CWT8.

In the first level of first repeat unit A1, the first clock signal terminal CK1 of the first shift register SR1 is further electrically connected with the low level signal line VGL through the first clock switch CWT1, the third clock signal terminal CK3 of the first shift register SR1 is further electrically connected with the low level signal line VGL through the third clock switch CWT3, the fifth clock signal terminal CK5 of the third shift register SR3 is further electrically connected with the low level signal line VGL through the fifth clock switch CWT5, and the seventh clock signal terminal CK7 of the third shift register SR3 is further electrically connected with the low level signal line VGL through the seventh clock switch CWT7; and In the first level of second repeat unit B1, the second clock signal terminal CK2 of the second shift register SR2 is further electrically connected with the low level signal line VGL through the second clock switch CWT2, the fourth clock signal terminal CK4 of the second shift register SR2 is further electrically connected with the low level signal line VGL through the fourth clock switch CWT4, the sixth clock signal terminal CK6 of the fourth shift register SR4 is further electrically connected with the low level signal line VGL through the sixth clock switch CWT6, and the eighth clock signal terminal CK8 of the fourth shift register SR4 is further electrically connected with the low level signal line VGL through the eighth clock switch CWT8.

In 2D display, during the first period of time P1 and the second period of time P2, the first clock switch CWT1, the second clock switch CWT2, the third clock switch CWT3, the fourth clock switch CWT4, the fifth clock switch CWT5, the sixth clock switch CWT6, the seventh clock switch CWT7 and the eighth clock switch CWT8 are turned off; and In 3D display, during the first period of time P1, the first clock switch CWT1, the third clock switch CWT3, the fifth clock switch CWT5 and the seventh clock switch CWT7 are turned off, and the second clock switch CWT2, the fourth clock switch CWT4, the sixth clock switch CWT6 and the eighth clock switch CWT8 are turned on; and during the second period of time P2, the first clock switch CWT1, the third clock switch CWT3, the fifth clock switch CWT5 and the seventh clock switch CWT7 are turned on, and the second clock switch CWT2, the fourth clock switch CWT4, the sixth clock switch CWT6 and the eighth clock switch CWT8 are turned off.

Furthermore the TFT array substrate 100 further includes a low level signal line VGL, a first signal switch RWT1 and a second signal switch RWT2.

The first terminal RST1 of the first shift register SR1 in the first level of first repeat unit A1 is further electrically connected with the low level signal line VGL through the first signal switch RWT1; and The second terminal RST2 of the second shift register SR2 in the first level of second repeat unit B1 is further electrically connected with the low level signal line VGL through the second signal switch RWT2.

In 2D display, during the first period of time P1 and the second period of time P2, the first signal switch RWT1 and the second signal switch RWT2 are turned off; and In 3D display, during the first period of time P1, the first signal switch RWT1 is turned off, and the second signal switch RWT2 is turned on; and during the second period of time P2, the first signal switch RWT1 is turned on, and the second signal switch RWT2 is turned off.

The invention further provides a ninth embodiment as illustrated in FIG. 1*a*, FIG. 1*c*, FIG. 10 and FIG. 11, and the same points of the ninth embodiment as the fifth embodiment will not be described again. On the basis of the fifth embodiment, in the TFT array substrate 100 according to the ninth embodiment, Each level of first repeat unit A further includes a fifth shift register SR5 and a seventh shift register SR7, where the fifth shift register SR5 includes a fifth input terminal IN5 and a fifth output terminal OUT5 connected with the corresponding gate line, and the seventh shift register SR7 includes a seventh input terminal IN7 and a seventh output terminal OUT7 connected with the corresponding gate line; and Each level of second repeat unit B further includes a sixth shift register SR6 and an eighth shift register SR8, where the sixth shift register SR6 includes a sixth input terminal IN6 and a sixth output terminal OUT6 connected with the corresponding gate line, and the eighth shift register SR8 includes an eighth input terminal IN8 and an eighth output terminal OUT8 connected with the corresponding gate line.

The TFT array substrate 100 further includes a fifth start transistor K5, a sixth start transistor K6, a seventh start transistor K7 and an eighth start transistor K8.

The drain of the fifth start transistor K5 is electrically connected with the third start signal line S3, the source S thereof is electrically connected with the fifth input terminal IN5 of the fifth shift register SR5 in the first level of first repeat unit A1, and the gate thereof is electrically connected with the first control line SW1;

The drain of the sixth start transistor K6 is electrically connected with the third start signal line S3, the source S thereof is electrically connected with the sixth input terminal IN6 of the sixth shift register SR6 in the first level of second repeat unit B1, and the gate thereof is electrically connected with the second control line SW2;

The drain of the seventh start transistor K7 is electrically connected with the fourth start signal line S4, the source S thereof is electrically connected with the seventh input terminal IN7 of the seventh shift register SR7 in the first level of first repeat unit A1, and the gate thereof is electrically connected with the first control line SW1; and The drain of the eighth start transistor K8 is electrically connected with the fourth start signal line S4, the source S thereof is electrically connected with the eighth input terminal IN8 of the eighth shift register SR8 in the first level of second repeat unit B1, and the gate thereof is electrically connected with the second control line SW2.

Among the second to m-th levels of first repeat units A, the first input terminal IN1 of the first shift register SR1 in the i-th level of first repeat unit A is electrically connected with the first output terminal OUT1 of the first shift register SR1 in the (i−1)-th level of first repeat unit A, the third input terminal IN3 of the third shift register SR3 in the i-th level of first repeat unit A is electrically connected with the third output terminal OUT3 of the third shift register SR3 in the (i−1)-th level of first repeat unit A, the fifth input terminal IN5 of the fifth shift register SR5 in the i-th level of first repeat unit A is electrically connected with the fifth output terminal OUT5 of the fifth shift register SR5 in the (i−1)-th level of first repeat unit A, and the seventh input terminal IN7 of the seventh shift register SR7 in the i-th level of first repeat unit A is electrically connected with the seventh output terminal OUT7 of the seventh shift register SR7 in the (i−1)-th level of first repeat unit A, for example, the first input terminal IN1 of the first shift register SR1 in the second level of first repeat unit A2 is electrically connected with the first output terminal OUT1 of the first shift register SR1 in the first level of first repeat unit A1, the third input terminal IN3 of the third shift register SR3 in the second level of first repeat unit A2 is electrically connected with the third output terminal OUT3 of the third shift register SR3 in the first level of first repeat unit A1, the fifth input terminal IN5 of the fifth shift register SR5 in the second level of first repeat unit A2 is electrically connected with the fifth output terminal OUT5 of the fifth shift register SR5 in the first level of first repeat unit A1, and the seventh input terminal IN7 of the seventh shift register SR7 in the second level of first repeat unit A2 is electrically connected with the seventh output terminal OUT7 of the seventh shift register SR7 in the first level of first repeat unit A1; and Among the second to n-th levels of second repeat units B, the second input terminal IN2 of the second shift register SR2 in the i-th level of second repeat unit B is electrically connected with the second output terminal OUT2 of the second shift register SR2 in the (i−1)-th level of second repeat unit B, the fourth input terminal IN4 of the fourth shift register SR4 in the i-th level of second repeat unit B is electrically connected with the fourth output terminal OUT4 of the fourth shift register SR4 in the (i−1)-th level of second repeat unit B, the sixth input terminal IN6 of the sixth shift register SR6 in the i-th level of second repeat unit B is electrically connected with the sixth output terminal OUT6 of the sixth shift register SR6 in the (i−1)-th level of second repeat unit B, and the eighth input terminal IN8 of the eighth shift register SR8 in the i-th level of second repeat unit B is electrically connected with the eighth output terminal OUT8 of the eighth shift register SR8 in the (i−1)-th level of second repeat unit B, for example, the second input terminal IN2 of the second shift register SR2 in the second level of second repeat unit B2 is electrically connected with the second output terminal OUT2 of the second shift register SR2 in the first level of second repeat unit B1, the fourth input terminal IN4 of the fourth shift register SR4 in the second level of second repeat unit B2 is electrically connected with the fourth output terminal OUT4 of the fourth shift register SR4 in the first level of second repeat unit B1, the sixth input terminal IN6 of the sixth shift register SR6 in the second level of second repeat unit B2 is electrically connected with the sixth output terminal OUT6 of the sixth shift register SR6 in the first level of second repeat unit B1, and the eighth input terminal IN8 of the eighth shift register SR8 in the second level of second repeat unit B2 is electrically connected with the eighth output terminal OUT8 of the eighth shift register SR8 in the first level of second repeat unit B1.

In 2D display, during the first period of time P1 and the second period of time P2, the first control line SW1 controls the fifth start transistor K5 and the seventh start transistor K7 to be turned on, and the second control line SW2 controls the sixth start transistor K6 and the eighth start transistor K8 to be turned on; and In 3D display, during the first period of time P1, the first control line SW1 controls the fifth start transistor K5 and the seventh start transistor K7 to be turned on, and the second control line SW2 controls the sixth start transistor K6 and the eighth start transistor K8 to be turned off; and during the second period of time P2, the first control line SW1 controls the fifth start transistor K5 and the seventh start transistor K7 to be turned off, and the second control line SW2 controls the sixth start transistor K6 and the eighth start transistor K8 to be turned on.

Furthermore the first shift register SR1 further includes a first zeroing terminal R1, the second shift register SR2 further includes a second zeroing terminal R2, the third shift register SR3 further includes a third zeroing terminal R3, the fourth shift register SR4 further includes a fourth zeroing terminal R4, the fifth shift register SR5 further includes a fifth zeroing terminal R5, the sixth shift register SR6 further includes a sixth zeroing terminal R6, the seventh shift register SR7 further includes a seventh zeroing terminal R7, and the eighth shift register SR8 further includes an eighth zeroing terminal R8.

Among the first to (m−1)-th levels of first repeat units A, the first zeroing terminal R1 of the first shift register SR1 in the k-th level of first repeat unit A is electrically connected with the first output terminal OUT1 of the first shift register SR1 in the (k+1)-th level of first repeat unit A, the third zeroing terminal R3 of the third shift register SR3 in the k-th level of first repeat unit A is electrically connected with the third output terminal OUT3 of the third shift register SR3 in the (k+1)-th level of first repeat unit A, the fifth zeroing terminal R5 of the fifth shift register SR5 in the k-th level of first repeat unit A is electrically connected with the fifth output terminal OUT5 of the fifth shift register SR5 in the (k+1)-th level of first repeat unit A, and the seventh zeroing terminal R7 of the seventh shift register SR7 in the k-th level of first repeat unit A is electrically connected with the seventh output terminal OUT7 of the seventh shift register SR7 in the (k+1)-th level of first repeat unit A, for example, the first zeroing terminal R1 of the first shift register SR1 in the first level of first repeat unit A1 is electrically connected with the first output terminal OUT1 of the first shift register SR1 in the second level of first repeat unit A2, the third zeroing terminal R3 of the third shift register SR3 in the first level of first repeat unit A1 is electrically connected with the third output terminal OUT3 of the third shift register SR3 in the second level of first repeat unit A2, the fifth zeroing terminal R5 of the fifth shift register SR5 in the first level of first repeat unit A1 is electrically connected with the fifth output terminal OUT5 of the fifth shift register SR5 in the second level of first repeat unit A2, and the seventh zeroing terminal R7 of the seventh shift register SR7 in the first level of first repeat unit A1 is electrically connected with the seventh output terminal OUT7 of the seventh shift register SR7 in the second level of first repeat unit A2; and Among the first to (n−1)-th levels of second repeat units B, the second zeroing terminal R2 of the second shift register SR2 in the k-th level of second repeat unit B is electrically connected with the second output terminal OUT2 of the second shift register SR2 in the (k+1)-th level of second repeat unit B, the fourth zeroing terminal R4 of the fourth shift register SR4 in the k-th level of second repeat unit B is electrically connected with the fourth output terminal OUT4 of the fourth shift register SR4 in the (k+1)-th level of second repeat unit B, the sixth zeroing terminal R6 of the sixth shift register SR6 in the k-th level of second repeat unit B is electrically connected with the sixth output terminal OUT6 of the sixth shift register SR6 in the (k+1)-th level of second repeat unit B, and the eighth zeroing terminal R8 of the eighth shift register SR8 in the k-th level of second repeat unit B is electrically connected with the eighth output terminal OUT8 of the eighth shift register SR8 in the (k+1)-th level of second repeat unit B, for example, the second zeroing terminal R2 of the second shift register SR2 in the first level of second repeat unit B1 is electrically connected with the second output terminal OUT2 of the second shift register SR2 in the second level of second repeat unit B2, the fourth zeroing terminal R4 of the fourth shift register SR4 in the first level of second repeat unit B1 is electrically connected with the fourth output terminal OUT4 of the fourth shift register SR4 in the second level of second repeat unit B2, the sixth zeroing terminal R6 of the sixth shift register SR6 in the first level of second repeat unit B1 is electrically connected with the sixth output terminal OUT6 of the sixth shift register SR6 in the second level of second repeat unit B2, and the eighth zeroing terminal R8 of the eighth shift register SR8 in the first level of second repeat unit B1 is electrically connected with the eighth output terminal OUT8 of the eighth shift register SR8 in the second level of second repeat unit B2, where K is a positive integer, and 1<<k<<m−1 and 1<<k<<n−1.

Figure 12:
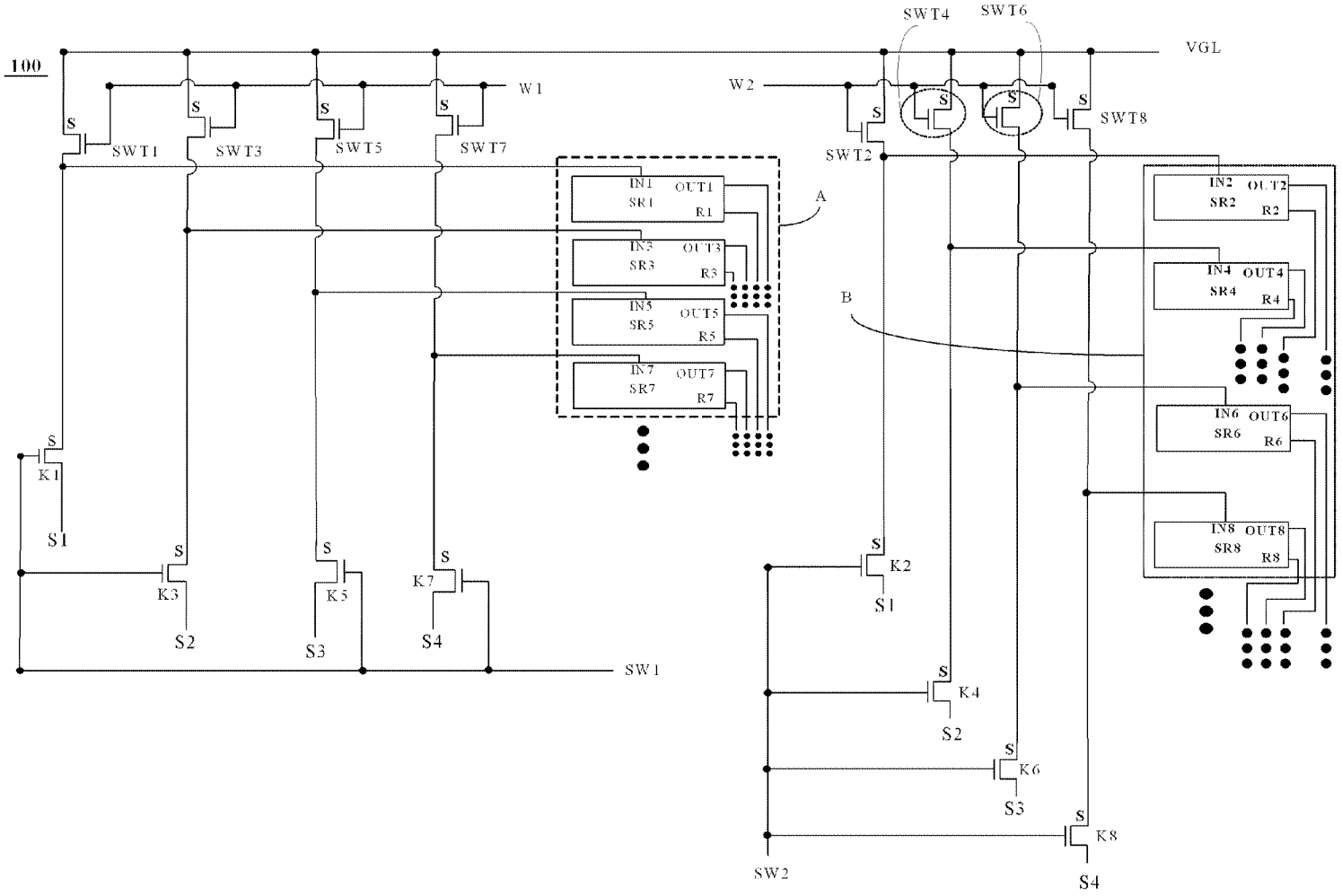
FIG. 12 illustrates a schematic structural diagram of a TFT array substrate according to a tenth embodiment of the invention.

The invention further provides a tenth embodiment as illustrated in FIG. 1*a*, FIG. 1*c* and FIG. 12, and the same points of the tenth embodiment as the ninth embodiment will not be described again. On the basis of the ninth embodiment, the TFT array substrate 100 according to the tenth embodiment further includes a low level signal line VGL, a first start switch SWT1, a second start switch SWT2, a third start switch SWT3, a fourth start switch SWT4, a fifth start switch SWT5, a sixth start switch SWT6, a seventh start switch SWT7 and an eighth start switch SWT8.

In the first level of first repeat unit A1, the first input terminal IN1 of the first shift register SR1 is further electrically connected with the low level signal line VGL through the first start switch SWT1, the third input terminal IN3 of the third shift register SR3 is further electrically connected with the low level signal line VGL through the third start switch SWT3, the fifth input terminal IN5 of the fifth shift register SR5 is further electrically connected with the low level signal line VGL through the fifth start switch SWT5, and the seventh input terminal IN7 of the seventh shift register SR7 is further electrically connected with the low level signal line VGL through the seventh start switch SWT7; and In the first level of second repeat unit B1, the second input terminal IN2 of the second shift register SR2 is further electrically connected with the low level signal line VGL through the second start switch SWT2, the fourth input terminal IN4 of the fourth shift register SR4 is further electrically connected with the low level signal line VGL through the fourth start switch SWT4, the sixth input terminal IN6 of the sixth shift register SR6 is further electrically connected with the low level signal line VGL through the sixth start switch SWT6, and the eighth input terminal IN8 of the eighth shift register SR8 is further electrically connected with the low level signal line VGL through the eighth start switch SWT8.

In 2D display, during the first period of time P1 and the second period of time P2, the first start switch SWT1, the second start switch SWT2, the third start switch SWT3, the fourth start switch SWT4, the fifth start switch SWT5, the sixth start switch SWT6, the seventh start switch SWT7 and the eighth start switch SWT8 are all turned off; and In 3D display, during the first period of time P1, the first start switch SWT1, the third start switch SWT3, the fifth start switch SWT5 and the seventh start switch SWT7 are turned off, and the second start switch SWT2, the fourth start switch SWT4, the sixth start switch SWT6 and the eighth start switch SWT8 are turned on; and during the second period of time P2, the first start switch SWT1, the third start switch SWT3, the fifth start switch SWT5 and the seventh start switch SWT7 are turned on, and the second start switch SWT2, the fourth start switch SWT4, the sixth start switch SWT6 and the eighth start switch SWT8 are turned off.

Figure 13:
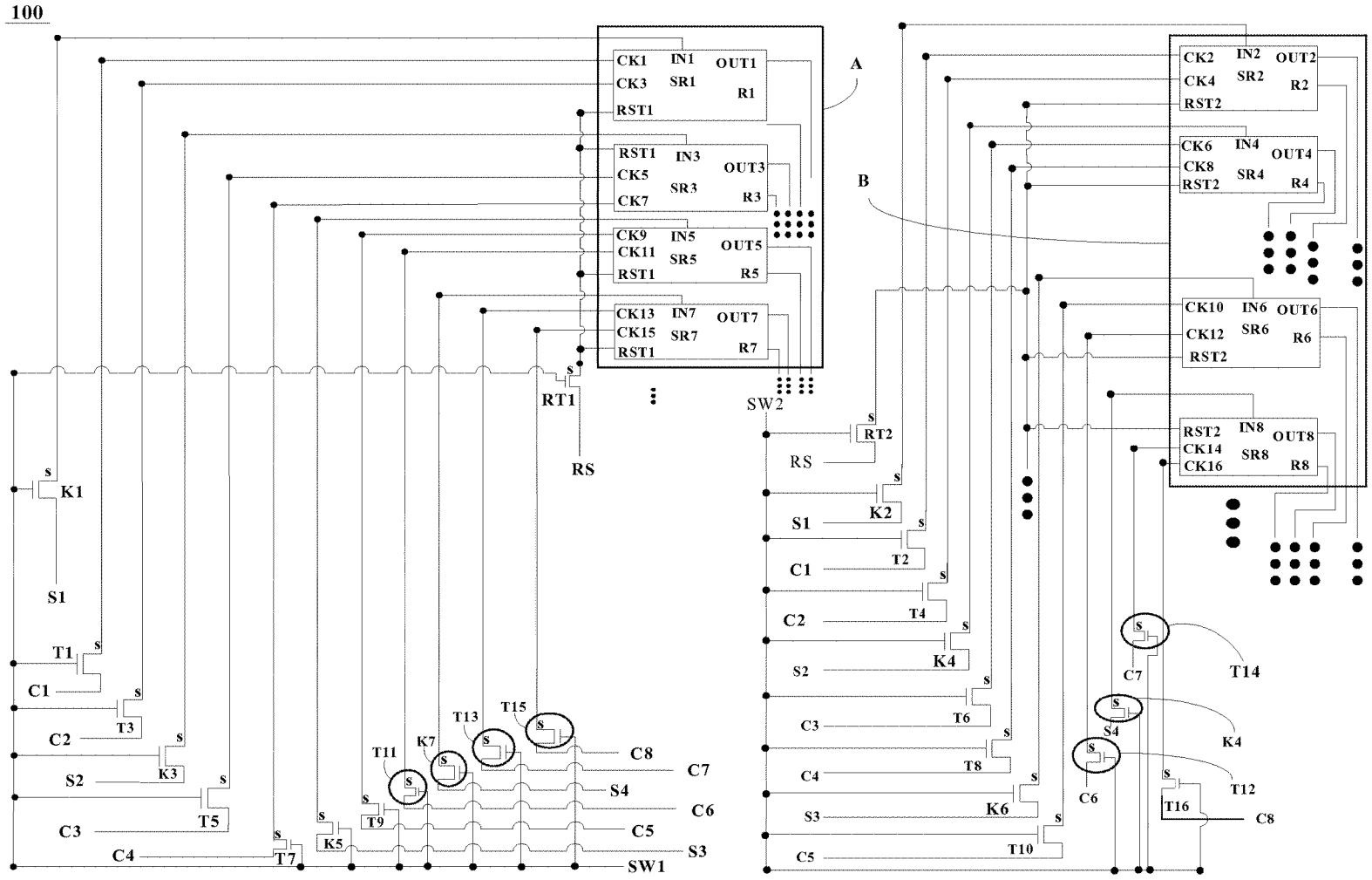
FIG. 13 illustrates a schematic structural diagram of a TFT array substrate according to an eleventh embodiment of the invention.

The invention further provides an eleventh embodiment as illustrated in FIG. 1*a*, FIG. 1*c* and FIG. 13, and the same points of the eleventh embodiment as the ninth embodiment will not be described again. On the basis of the ninth embodiment, the TFT array substrate 100 according to the eleventh embodiment further includes a first clock signal line C1, a first clock transistor T1, a second clock transistor T2, a second clock signal line C2, a third clock transistor T3, a fourth clock transistor T4, a third clock signal line C3, a fifth clock transistor T5, a sixth clock transistor T6, a fourth clock signal line C4, a seventh clock transistor T7, an eighth clock transistor T8, a fifth clocks signal line C5, a ninth clock transistor T9, a tenth clock transistor T10, a sixth clock signal line C6, an eleventh clock transistor T11, a twelfth clock transistor T12, a seventh clock signal line C7, a thirteenth clock transistor T13, a fourteenth clock transistor T14, an eighth clock signal line C8, a fifteen clock transistor T15 and a sixteen clock transistor T16; the first shift register SR1 further includes a first clock signal terminal CK1, a third clock signal terminal CK3, a fifth clock signal terminal CK5, a seventh clock signal terminal CK7, a ninth clock signal terminal CK9, an eleventh clock signal terminal CK11, a thirteenth clock signal terminal CK13 and a fifteenth clock signal terminal CK15; and the second shift register SR2 further includes a second clock signal terminal CK2, a fourth clock signal terminal CK4, a sixth clock signal terminal CK6, an eighth clock signal terminal CK8, a tenth clock signal terminal CK10, a twelfth clock signal terminal CK12, a fourteenth clock signal terminal CK14 and a sixteenth clock signal terminal CK16.

In each level of first repeat unit A, the drain of the first clock transistor T1 is electrically connected with the first clock signal line C1, the gate thereof is electrically connected with the first control line SW1, and the source S thereof is electrically connected with the first clock signal terminal CK1; the drain of the third clock transistor T3 is electrically connected with the second clock signal line C2, the gate thereof is electrically connected with the first control line SW1, and the source S thereof is electrically connected with the third clock signal terminal CK3; the drain of the fifth clock transistor T5 is electrically connected with the third clock signal line C3, the gate thereof is electrically connected with the first control line SW1, and the source S thereof is electrically connected with the fifth clock signal terminal CK5; the drain of the seventh clock transistor T7 is electrically connected with the fourth clock signal line C4, the gate thereof is electrically connected with the first control line SW1, and the source S thereof is electrically connected with the seventh clock signal terminal CK7; the drain of the ninth clock transistor T9 is electrically connected with the fifth clock signal line C5, the gate thereof is electrically connected with the first control line SW1, and the source S thereof is electrically connected with the ninth clock signal terminal CK9; the drain of the eleventh clock transistor T11 is electrically connected with the sixth clock signal line C6, the gate thereof is electrically connected with the first control line SW1, and the source S thereof is electrically connected with the eleventh clock signal terminal CK11; the drain of the thirteenth clock transistor T13 is electrically connected with the seventh clock signal line C7, the gate thereof is electrically connected with the first control line SW1, and the source S thereof is electrically connected with the thirteenth clock signal terminal CK13; and the drain of the fifteenth clock transistor T15 is electrically connected with the eighth clock signal line C8, the gate thereof is electrically connected with the first control line SW1, and the source S thereof is electrically connected with the fifteenth clock signal terminal CK15; and In each level of second repeat unit B, the drain of the second clock transistor T2 is electrically connected with the first clock signal line C1, the gate thereof is electrically connected with the second control line SW2, and the source S thereof is electrically connected with the second clock signal terminal CK2; the drain of the fourth clock transistor T4 is electrically connected with the second clock signal line C2, the gate thereof is electrically connected with the second control line SW2, and the source S thereof is electrically connected with the fourth clock signal terminal CK4; the drain of the sixth clock transistor T6 is electrically connected with the third clock signal line C3, the gate thereof is electrically connected with the second control line SW2, and the source S thereof is electrically connected with the sixth clock signal terminal CK6; the drain of the eighth clock transistor T8 is electrically connected with the fourth clock signal line C4, the gate thereof is electrically connected with the second control line SW2, and the source S thereof is electrically connected with the eighth clock signal terminal CK8; the drain of the tenth clock transistor T10 is electrically connected with the fifth clock signal line C5, the gate thereof is electrically connected with the second control line SW2, and the source S thereof is electrically connected with the tenth clock signal terminal CK10; the drain of the twelfth clock transistor T12 is electrically connected with the sixth clock signal line C6, the gate thereof is electrically connected with the second control line SW2, and the source S thereof is electrically connected with the twelfth clock signal terminal CK12; the drain of the fourteenth clock transistor T14 is electrically connected with the seventh clock signal line C7, the gate thereof is electrically connected with the second control line SW2, and the source S thereof is electrically connected with the fourteenth clock signal terminal CK14; and the drain of the sixteenth clock transistor T16 is electrically connected with the eighth clock signal line C8, the gate thereof is electrically connected with the second control line SW2, and the source S thereof is electrically connected with the sixteenth clock signal terminal CK16.

In 2D display, during the first period of time P1 and the second period of time P2, the first control line SW1 controls the first clock transistor T1, the third clock transistor T3, the fifth clock transistor T5, the seventh clock transistor T7, the ninth clock transistor T9, the eleventh clock transistor T11, the thirteenth clock transistor T13 and the fifteenth clock transistor T15 to be turned on, and the second control line SW2 controls the second clock transistor T2, the fourth clock transistor T4, the sixth clock transistor T6, the eighth clock transistor T8, the tenth clock transistor T10, the twelfth clock transistor T12, the fourteenth clock transistor T14 and the sixteenth clock transistor T16 to be turned on; and In 3D display, during the first period of time P1, the first control line SW1 controls the first clock transistor T1, the third clock transistor T3, the fifth clock transistor T5, the seventh clock transistor T7, the ninth clock transistor T9, the eleventh clock transistor T11, the thirteenth clock transistor T13 and the fifteenth clock transistor T15 to be turned on, and the second control line SW2 controls the second clock transistor T2, the fourth clock transistor T4, the sixth clock transistor T6, the eighth clock transistor T8, the tenth clock transistor T10, the twelfth clock transistor T12, the fourteenth clock transistor T14 and the sixteenth clock transistor T16 to be turned off; and during the second period of time P2, the first control line SW1 controls the first clock transistor T1, the third clock transistor T3, the fifth clock transistor T5, the seventh clock transistor T7, the ninth clock transistor T9, the eleventh clock transistor T11, the thirteenth clock transistor T13 and the fifteenth clock transistor T15 to be turned off, and the second control line SW2 controls the second clock transistor T2, the fourth clock transistor T4, the sixth clock transistor T6, the eighth clock transistor T8, the tenth clock transistor T10, the twelfth clock transistor T12, the fourteenth clock transistor T14 and the sixteenth clock transistor T16 to be turned on.

Furthermore the TFT array substrate 100 further includes a first signal line RS, a first transistor RT1 and a second transistor RT2; each of the first shift register SR1, the third shift register SR3, the fifth shift register SR5 and the seventh shift register SR7 further includes a first terminal RST1; and each of the second shift register SR2, the fourth shift register SR4, the sixth shift register SR6 and the eighth shift register SR8 further includes a second terminal RST2.

In each level of first repeat unit A, the drain of the first transistor RT1 is electrically connected with the first signal line RS, the gate thereof is electrically connected with the first control line SW1, and the source S thereof is electrically connected with the first terminal RST1; and In each level of second repeat unit B, the drain of the second transistor RT2 is electrically connected with the first signal line RS, the gate thereof is electrically connected with the second control line SW2, and the source S thereof is electrically connected with the second terminal RST2.

In 2D display, during the first period of time P1 and the second period of time P2, the first control line SW1 controls the first transistor RT1 to be turned on, and the second control line SW2 controls the second transistor RT2 to be turned on; and In 3D display, during the first period of time P1, the first control line SW1 controls the first transistor RT1 to be turned on, and the second control line SW2 controls the second transistor RT2 to be turned off; and during the second period of time P2, the first control line SW1 controls the first transistor RT1 to be turned off, and the second control line SW2 controls the second transistor RT2 to be turned on.

The first signal line RS can output a pre-scan rest signal; or the first signal line RS can output a constant high level signal; or the first signal line RS can output a constant low level signal; or the first signal line RS can output a forward scan signal; or the first signal line RS can output a backward scan signal.

Figure 14:
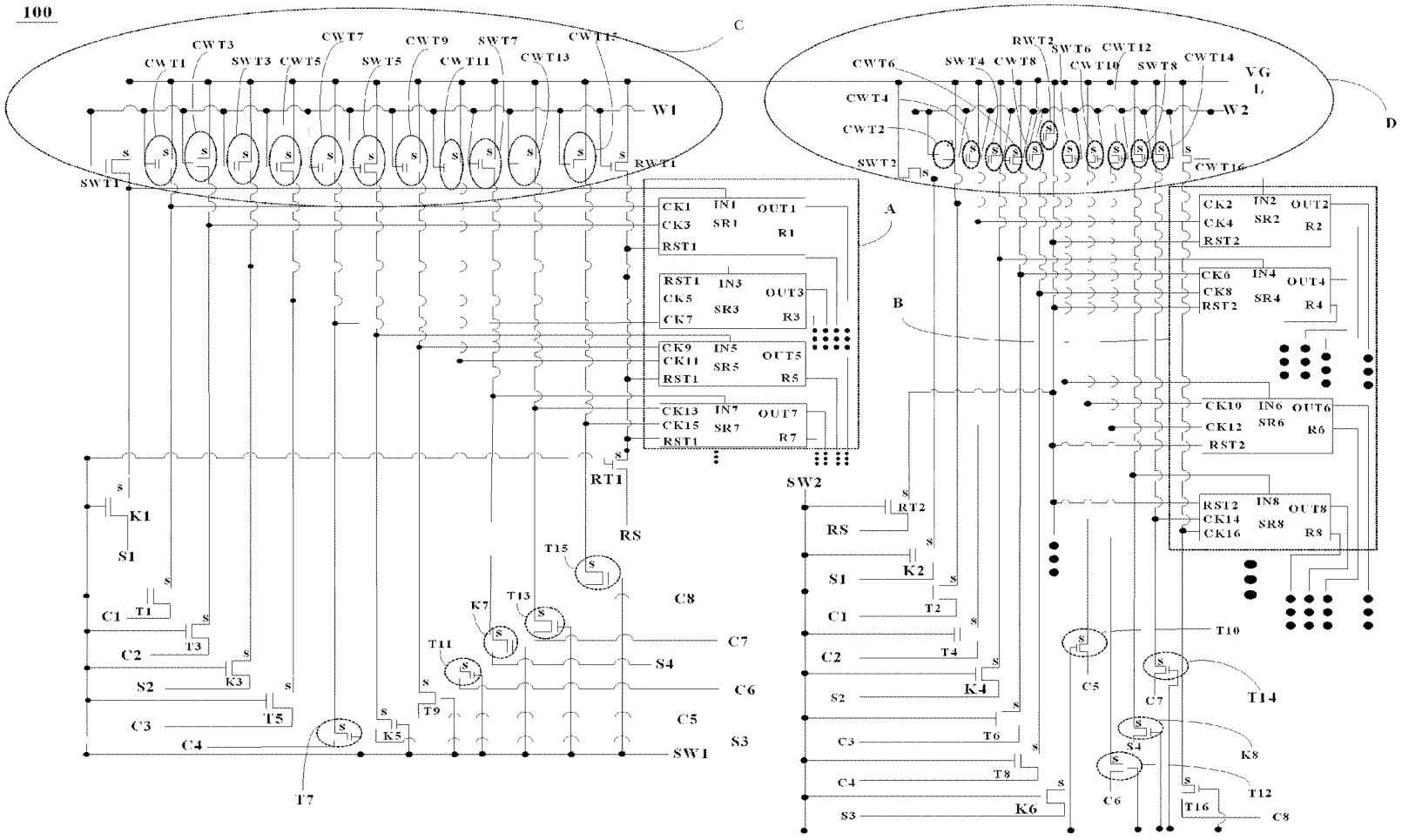
FIG. 14 illustrates a schematic structural diagram of a TFT array substrate according to a twelfth embodiment of the invention.
Figure 15A:
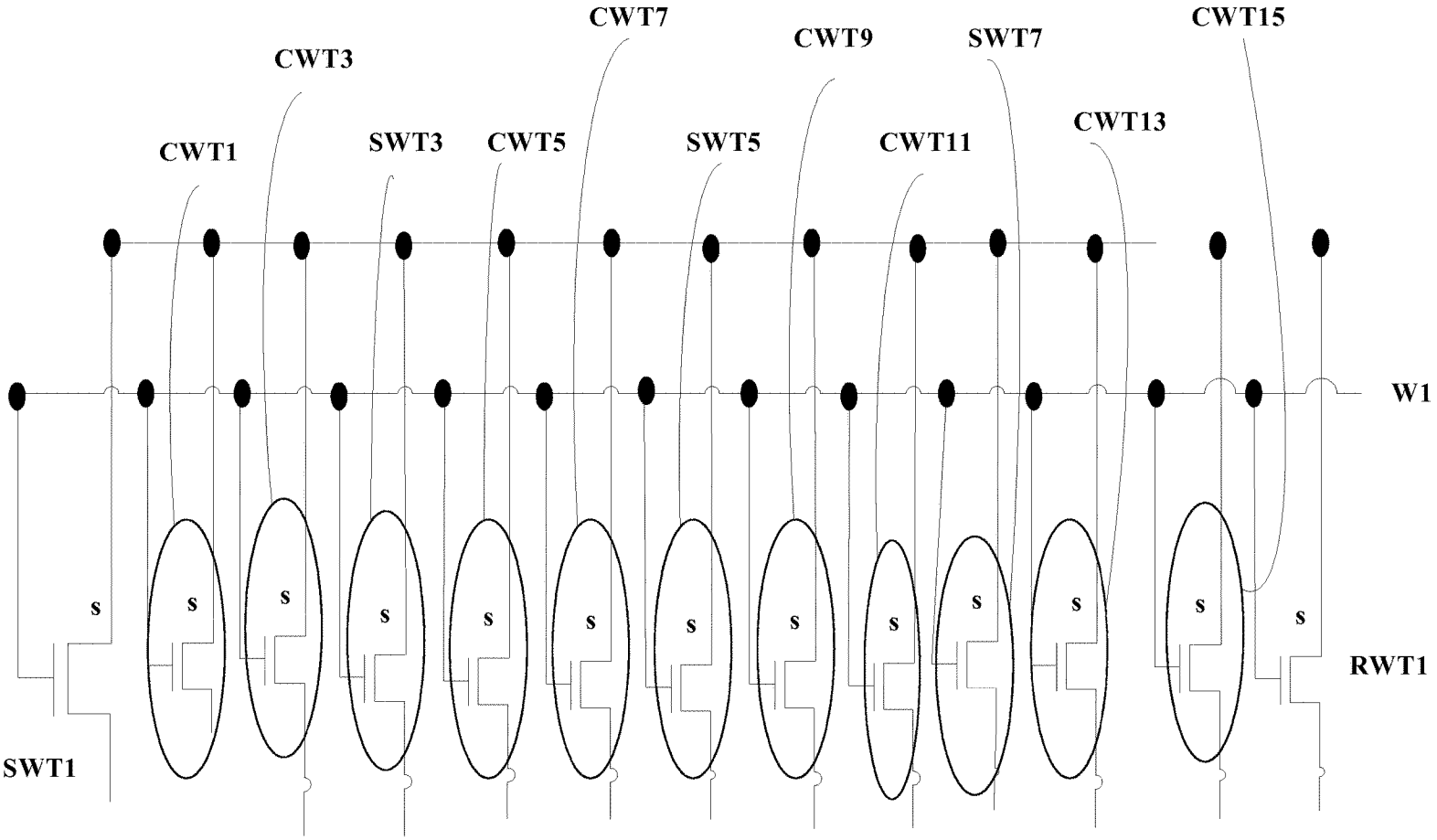
FIG. 15*a* illustrates an enlarged diagram of the region C in FIG. 14.
Figure 15B:
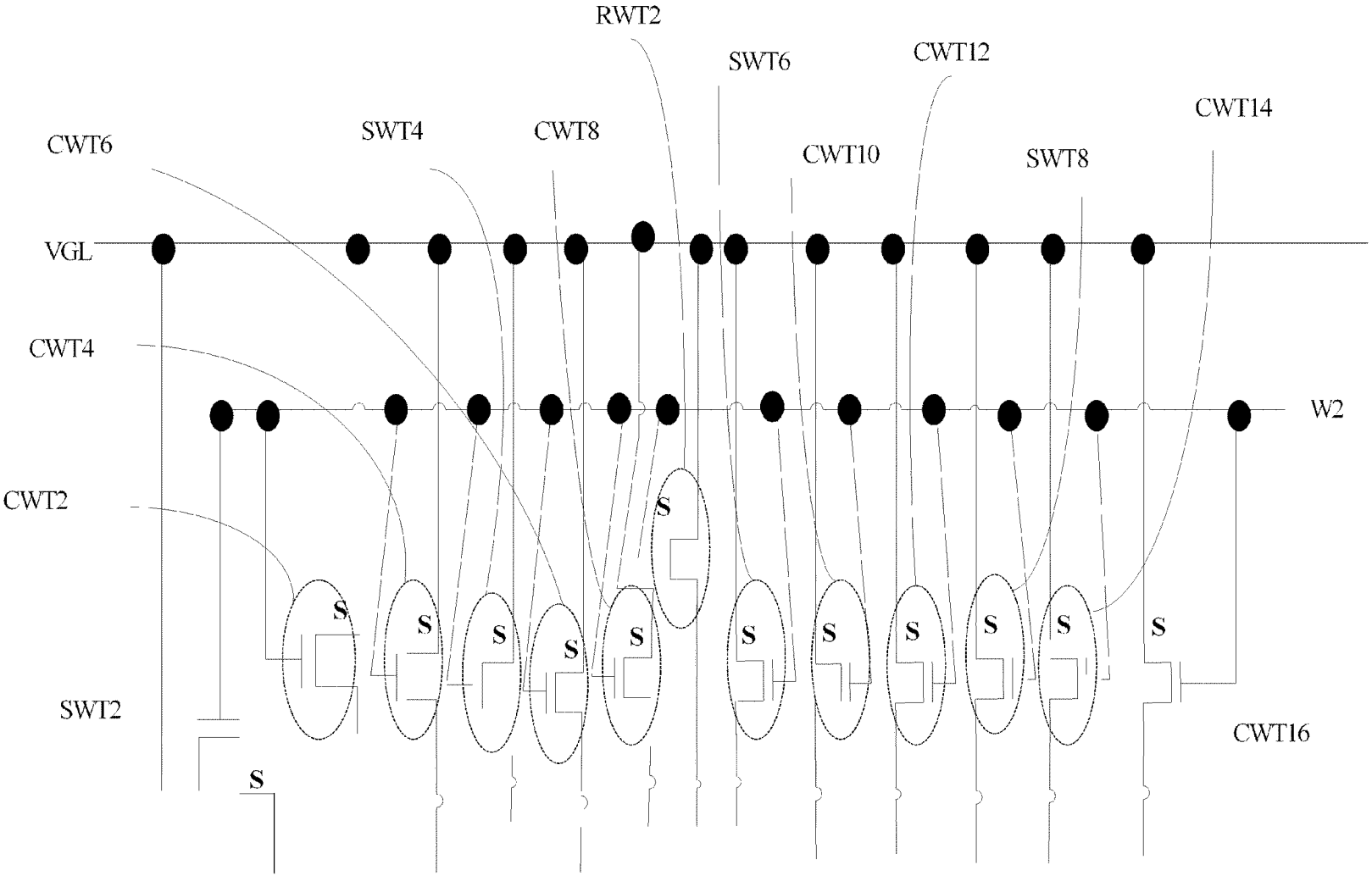
FIG. 15*b* illustrates an enlarged diagram of the region D in FIG. 14.

The invention further provides a twelfth embodiment as illustrated in FIG. 1*a*, FIG. 1*c*, FIG. 14, FIG. 15*a* and FIG. 15*b*, where FIG. 15*a* and FIG. 15*b* illustrate enlarged diagrams of parts in the region C and the region D in FIG. 14 respectively, and the same points of the twelfth embodiment as the eleventh embodiment will not be described again, and particularly, on the basis of the eleventh embodiment, the TFT array substrate 100 according to the twelfth embodiment further includes a low level signal line VGL and first to sixteenth clock switches CWT1 to CWT16.

In the first level of first repeat unit A1, the first clock signal terminal CK1 of the first shift register SR1 is further electrically connected with the low level signal line VGL through the first clock switch CWT1, the third clock signal terminal CK3 of the first shift register SR1 is further electrically connected with the low level signal line VGL through the third clock switch CWT3, the fifth clock signal terminal CK5 of the third shift register SR3 is further electrically connected with the low level signal line VGL through the fifth clock switch CWT5, the seventh clock signal terminal CK7 of the third shift register SR3 is further electrically connected with the low level signal line VGL through the seventh clock switch CWT7, the ninth clock signal terminal CK9 of the fifth shift register SR5 is further electrically connected with the low level signal line VGL through the ninth clock switch CWT9, the eleventh clock signal terminal CK11 of the fifth shift register SR5 is further electrically connected with the low level signal line VGL through the eleventh clock switch CWT11, the thirteenth clock signal terminal CK13 of the seventh shift register SR7 is further electrically connected with the low level signal line VGL through the thirteenth clock switch CWT13, and the fifteenth clock signal terminal CK15 of the seventh shift register SR7 is further electrically connected with the low level signal line VGL through the fifteenth clock switch CWT15; and In the first level of second repeat unit B1, the second clock signal terminal CK2 of the second shift register SR2 is further electrically connected with the low level signal line VGL through the second clock switch CWT2, the fourth clock signal terminal CK4 of the second shift register SR2 is further electrically connected with the low level signal line VGL through the fourth clock switch CWT4, the sixth clock signal terminal CK6 of the fourth shift register SR4 is further electrically connected with the low level signal line VGL through the sixth clock switch CWT6, the eighth clock signal terminal CK8 of the fourth shift register SR4 is further electrically connected with the low level signal line VGL through the eighth clock switch CWT8, the tenth clock signal terminal CK10 of the sixth shift register SR6 is further electrically connected with the low level signal line VGL through the tenth clock switch CWT10, the twelfth clock signal terminal CK12 of the sixth shift register SR6 is further electrically connected with the low level signal line VGL through the twelfth clock switch CWT12, the fourteenth clock signal terminal CK14 of the eighth shift register SR8 is further electrically connected with the low level signal line VGL through the fourteenth clock switch CWT14, and the sixteenth clock signal terminal CK16 of the eighth shift register SR8 is further electrically connected with the low level signal line VGL through the sixteenth clock switch CWT16.

In 2D display, during the first period of time P1 and the second period of time P2, the first to sixteenth clock switches CWT1 to CWT16 are all turned off; and In 3D display, during the first period of time P1, the first clock switch CWT1, the third clock switch CWT3, the fifth clock switch CWT5, the seventh clock switch CWT7, the ninth clock switch CWT9, the eleventh clock switch CWT11, the thirteenth clock switch CWT13 and the fifteenth clock switch CWT15 are turned off, and the second clock switch CWT2, the fourth clock switch CWT4, the sixth clock switch CWT6, the eighth clock switch CWT8, the tenth clock switch CWT10, the twelfth clock switch CWT12, the fourteenth clock switch CWT14 and the sixteenth clock switch CWT16 are turned on; and during the second period of time P2, the first clock switch CWT1, the third clock switch CWT3, the fifth clock switch CWT5, the seventh clock switch CWT7, the ninth clock switch CWT9, the eleventh clock switch CWT11, the thirteenth clock switch CWT13 and the fifteenth clock switch CWT15 are turned on, and the second clock switch CWT2, the fourth clock switch CWT4, the sixth clock switch CWT6, the eighth clock switch CWT8, the tenth clock switch CWT10, the twelfth clock switch CWT12, the fourteenth clock switch CWT14 and the sixteenth clock switch CWT16 are turned off.

Furthermore the TFT array substrate 100 further includes a first signal switch RWT1 and a second signal switch RWT2.

The first terminal RST1 of the first shift register SR1 in the first level of first repeat unit A1 is further electrically connected with the low level signal line VGL through the first signal switch RWT1; and The second terminal RST2 of the second shift register SR2 in the first level of second repeat unit B1 is further electrically connected with the low level signal line VGL through the second signal switch RWT2.

In 2D display, during the first period of time P1 and the second period of time P2, the first signal switch RWT1 and the second signal switch RWT2 are turned off; and In 3D display, during the first period of time P1, the first signal switch RWT1 is turned off, and the second signal switch RWT2 is turned on; and during the second period of time P2, the first signal switch RWT1 is turned on, and the second signal switch RWT2 is turned off.

Figure 16:
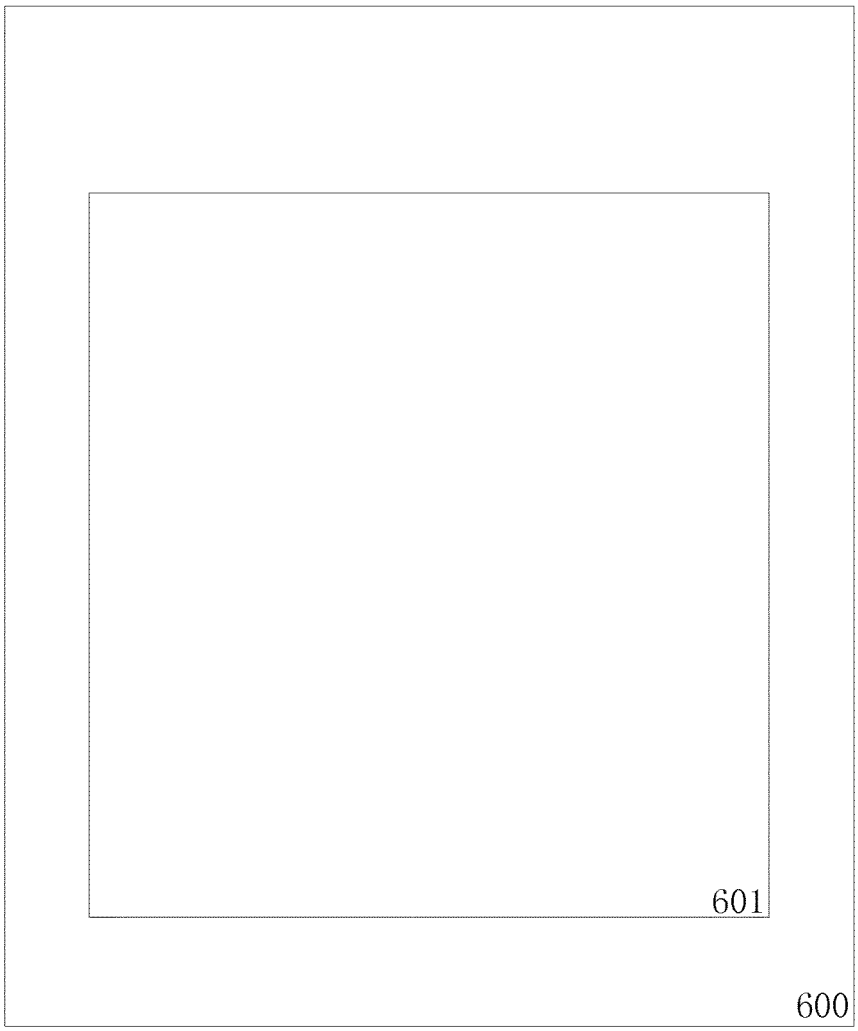
FIG. 16 illustrates a schematic structural diagram of a display panel according to an embodiment of the invention.

FIG. 16 illustrates a schematic structural diagram of a display panel according to an embodiment of the invention. Referring to FIG. 16, the display panel 600 in this embodiment includes a TFT array substrate 601 which is the TFT array substrate according to any one of the embodiments described above.

Figure 17:
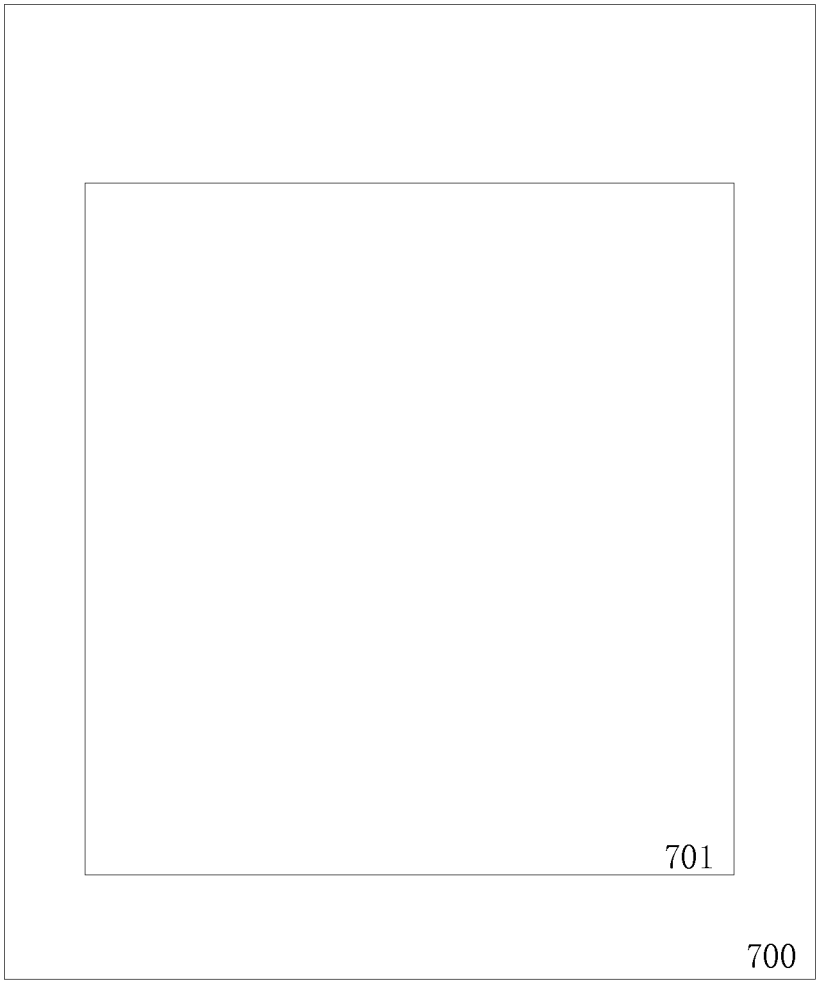
FIG. 17 illustrates a schematic structural diagram of a display device according to an embodiment of the invention.

FIG. 17 illustrates a schematic structural diagram of a display device according to an embodiment of the invention. Referring to FIG. 17, the display device in this embodiment is not limited to an Organic Light Emitting Display (OLED), a Liquid Crystal Display (LCD), an electronic paper or another display device; and particularly the display device 700 includes a TFT array substrate 701 which is the TFT array substrate according to any one of the embodiments described above.

In summary, with the TFT array substrate, the display panel and the display device according to the embodiments of the invention, in 2D display, during the first period of time and the second period of time, the first control line controls the first start transistor to be turned on, and the second control line controls the second start transistor to be turned on; and in 3D display, during the first period of time, the first control line controls the first start transistor to be turned on, and the second control line controls the second start transistor to be turned off, and during the second period of time, the first control line controls the first start transistor to be turned off, and the second control line controls the second start transistor to be turned on, so that the convenient and rapid conversion between the 2D display effect and the 3D display effect of the display device can be achieved.

In 2D display, during the first period of time P1 and the second period of time P2, the first start switch SWT1 and the second start switch SWT2 are turned off so that the adverse influence due to leakage current of the respective transistors can be prevented to improve the performance of the TFT array substrate.

In 3D display, during the first period of time P1, the first start switch SWT1 is turned off and the second start switch SWT2 is turned on so that the adverse influence due to leakage current of the respective transistors connected with the first start switch SWT1 can be prevented to improve the performance of the TFT array substrate; and during the second period of time P2, the first start switch SWT1 is turned on and the second start switch SWT2 is turned off so that the adverse influence due to leakage current of the respective transistors connected with the second start switch SWT2 can be prevented to improve the performance of the TFT array substrate.

The foregoing disclosure is merely illustrative of preferred embodiments of the invention but not intended to limit the invention, and it can be apparent to those skilled in the art that there can be various modifications and variations to the invention. Any modifications, equivalent substitutions, adaptations, etc., made without departing from the spirit and the principle of the invention shall be encompassed in the scope of the invention.

What is claimed is:

1. A thin film transistor (TFT) array substrate, comprising:

a plurality of gate lines; a first gate drive circuit, wherein the first gate drive circuit comprises m levels of first repeat units, wherein the m levels of first repeat units further comprise a first level of first repeat unit to an m-th level of first repeat unit sequentially arranged, wherein each level of the m levels of first repeat units further comprises a first shift register, wherein the first shift register further comprises a first input terminal and a first output terminal connected with a corresponding gate line;

a second gate drive circuit, wherein the second gate drive circuit comprises n levels of second repeat units, wherein the n levels of second repeat units further comprise a first level of second repeat unit to an n-th level of second repeat unit sequentially arranged, wherein each level of the n levels of second repeat units further comprises a second shift register, wherein the second shift register further comprises a second input terminal and a second output terminal connected with a corresponding gate line;

a first start signal line;

a first start transistor, wherein a drain of the first start transistor is electrically connected with the first start signal line, a source of the first start transistor is electrically connected with the first input terminal of the first shift register of the first level of first repeat unit, and a gate of the first start transistor is electrically connected with a first control line; and a second start transistor, wherein a drain of the second start transistor is electrically connected with the first start signal line, a source of the second start transistor is electrically connected with the second input terminal of the second shift register of the first level of second repeat unit, and a gate of the second start transistor is electrically connected with a second control line, wherein in the m levels of first repeat units, among the second to m-th levels of first repeat units, the first input terminal of the first shift register in an i-th level of first repeat unit is electrically connected with the first output terminal of the first shift register in the (i−1)-th level of first repeat unit, and wherein in the n levels of second repeat units, among the second to n-th levels of second repeat units, the second input terminal of the second shift register in an i-th level of second repeat unit is electrically connected with the second output terminal of the second shift register in the (i−1)-th level of second repeat unit and wherein m, n and i are positive integers, and i is greater than or equal to 2 and less than or equal to at least one of m and n, and wherein a frame comprises a first period of time and a second period of time, wherein: in two dimensional (2D) display: during the first period of time and during the second period of time, the first control line controls the first start transistor to be turned on, and the second control line controls the second start transistor to be turned on; and in three dimensional (3D) display: during the first period of time, the first control line controls the first start transistor to be turned on, and the second control line controls the second start transistor to be turned off; and during the second period of time, the first control line controls the first start transistor to be turned off and the second control line controls the second start transistor to be turned on, and wherein the TFT array substrate further comprises a first clock signal line, a first clock transistor, a second clock transistor, a second clock signal line, a third clock transistor, and a fourth clock transistor, wherein the first shift register further comprises a first clock signal terminal, and a third clock signal terminal, wherein the second shift register further comprises a second clock signal terminal and a fourth clock signal terminal, wherein: in each level of first repeat unit: a drain of the first clock transistor is electrically connected with the first clock signal line, a gate of the first clock transistor is electrically connected with the first control line, and a source of the first clock transistor is electrically connected with the first clock signal terminal; and a drain of the third clock transistor is electrically connected with the second clock signal line, a gate of the third clock transistor is electrically connected with the first control line, and a source of the third clock transistor is electrically connected with the third clock signal terminal; and in each level of second repeat unit: a drain of the second clock transistor is electrically connected with the first clock signal line, a gate of the second clock transistor is electrically connected with the second control line, and a source of the second clock transistor is electrically connected with the second clock signal terminal; and a drain of the fourth clock transistor is electrically connected with the second clock signal line, a gate of the fourth clock transistor is electrically connected with the second control line, and a source of the fourth clock transistor is electrically connected with the fourth clock signal terminal, and wherein: in the 2D display: during the first period of time and during the second period of time: the first control line controls the first clock transistor and the third clock transistor to be turned on, and the second control line controls the second clock transistor and the fourth clock transistor to be turned on; and in the 3D display: during the first period of time: the first control line controls the first clock transistor and the third clock transistor to be turned on, and the second control line controls the second clock transistor and the fourth clock transistor to be turned off; and during the second period of time: the first control line controls the first clock transistor and the third clock transistor to be turned off, and the second control line controls the second clock transistor and the fourth clock transistor to be turned on.

2. A thin film transistor (TFT) array substrate, comprising:

a plurality of gate lines;

a first gate drive circuit, wherein the first gate drive circuit comprises m levels of first repeat units, wherein the m levels of first repeat units further comprise a first level of first repeat unit to an m-th level of first repeat unit sequentially arranged, wherein each level of the m levels of first repeat units further comprises a first shift register, wherein the first shift register further comprises a first input terminal and a first output terminal connected with a corresponding gate line;

a second gate drive circuit, wherein the second gate drive circuit comprises n levels of second repeat units, wherein the n levels of second repeat units further comprise a first level of second repeat unit to an n-th level of second repeat unit sequentially arranged, wherein each level of the n levels of second repeat units further comprises a second shift register, wherein the second shift register further comprises a second input terminal and a second output terminal connected with a corresponding gate line;

a first start signal line; a first start transistor, wherein a drain of the first start transistor is electrically connected with the first start signal line, a source of the first start transistor is electrically connected with the first input terminal of the first shift register of the first level of first repeat unit, and a gate of the first start transistor is electrically connected with a first control line; and a second start transistor, wherein a drain of the second start transistor is electrically connected with the first start signal line, a source of the second start transistor is electrically connected with the second input terminal of the second shift register of the first level of second repeat unit, and a gate of the second start transistor is electrically connected with a second control line, wherein in the m levels of first repeat units, among the second to m-th levels of first repeat units, the first input terminal of the first shift register in an i-th level of first repeat unit is electrically connected with the first output terminal of the first shift register in the (i−1)-th level of first repeat unit, and wherein in the n levels of second repeat units, among the second to n-th levels of second repeat units, the second input terminal of the second shift register in an i-th level of second repeat unit is electrically connected with the second output terminal of the second shift register in the (i−1)-th level of second repeat unit, and wherein m, n and i are positive integers, and i is greater than or equal to 2 and less than or equal to at least one of m and n, and wherein a frame comprises a first period of time and a second period of time, wherein: in two dimensional (2D) display: during the first period of time and during the second period of time, the first control line controls the first start transistor to be turned on, and the second control line controls the second start transistor to be turned on; and in three dimensional (3D) display: during the first period of time, the first control line controls the first start transistor to be turned on, and the second control line controls the second start transistor to be turned off; and during the second period of time, the first control line controls the first start transistor to be turned off and the second control line controls the second start transistor to be turned on, and wherein the TFT array substrate further comprises a first signal line, a first transistor and a second transistor; and the first shift register further comprises a first terminal, and the second shift register further comprises a second terminal, wherein: in the each level of first repeat unit, a drain of the first transistor is electrically connected with the first signal line, a gate of the first transistor is electrically connected with the first control line, and a source of the first transistor is electrically connected with the first terminal; and in each level of the second repeat unit, a drain of the second transistor is electrically connected with the first signal line, a gate of the second transistor is electrically connected with the second control line, and a source of the second transistor is electrically connected with the second terminal, wherein: in the 2D display: during the first period of time and during the second period of time, the first control line controls the first transistor to be turned on, and the second control line controls the second transistor to be turned on; and in the 3D display: during the first period of time, the first control line controls the first transistor to be turned on, and the second control line controls the second transistor to be turned off, and during the second period of time, the first control line controls the first transistor to be turned off, and the second control line controls the second transistor to be turned on.

3. The TFT array substrate according to claim 2, wherein at least one of:

the first signal line outputs a pre-scan reset signal;

the first signal line outputs a constant high level signal;

the first signal line outputs a constant low level signal;

the first signal line outputs a forward scan signal; and the first signal line outputs a backward scan signal.

4. The TFT array substrate according to claim 1, further comprising a low level signal line, a first clock switch, a second clock switch, a third clock switch and a fourth clock switch, wherein:

the first clock signal terminal of the first shift register in the first level of first repeat unit is further electrically connected with the low level signal line through the first clock switch, and the third clock signal terminal of the first shift register in the first level of first repeat unit is further electrically connected with the low level signal line through the third clock switch; and the second clock signal terminal of the second shift register in the first level of second repeat unit is further electrically connected with the low level signal line through the second clock switch, and the fourth clock signal terminal of the second shift register in the first level of second repeat unit is further electrically connected with the low level signal line through the fourth clock switch, wherein:

in 2D display:

during the first period of time and during the second period of time, the first clock switch, the second clock switch, the third clock switch and the fourth clock switch are turned off; and in 3D display;

during the first period of time, the first clock switch and the third clock switch are turned off, and the second clock switch and the fourth clock switch are turned on, and during the second period of time, the first clock switch and the third clock switch are turned on, and the second clock switch and the fourth clock switch are turned off.

5. The TFT array substrate according to claim 2, further comprising a low level signal line, a first signal switch and a second signal switch, wherein:

the first terminal of the first shift register in the first level of first repeat unit is further electrically connected with the low level signal line through the first signal switch; and the second terminal of the second shift register in the first level of second repeat unit is further electrically connected with the low level signal line through the second signal switch, wherein:

in 2D display:

during the first period of time and during the second period of time, the first signal switch and the second signal switch are turned off; and in 3D display:

during the first period of time, the first signal switch is turned off, and the second signal switch is turned on, and during the second period of time, the first signal switch is turned on, and the second signal switch is turned off.

6. A display panel, comprising:

a thin film transistor (TFT) array substrate, wherein the TFT array substrate further comprises:

a plurality of gate lines; a first gate drive circuit, wherein the first gate drive circuit comprises m levels of first repeat units, wherein the m levels of first repeats units further comprise a first level of first repeat unit to an m-th level of first repeat unit sequentially arranged, wherein each level of the m levels of first repeat units further comprises a first shift register, wherein the first shift register further comprises a first input terminal and a first output terminal connected with a corresponding gate line;

a second gate drive circuit, wherein the second gate drive circuit comprises n levels of second repeat units, wherein the n levels of second repeat units further comprise a first level of second repeat unit to an n-th level of second repeat unit sequentially arranged, wherein each level of the n levels of second repeat units further comprises a second shift register, wherein the second shift register further comprises a second input terminal and a second output terminal connected with a corresponding gate line;

a first start signal line;

a first start transistor, wherein a drain of the first start transistor is electrically connected with the first start signal line, a source of the first start transistor is electrically connected with the first input terminal of the first shift register of the first level of first repeat unit, and a gate of the first start transistor is electrically connected with a first control line; and a second start transistor, wherein a drain of the second start transistor is electrically connected with the first start signal line, a source of the second start transistor is electrically connected with the second input terminal of the second shift register of the first level of second repeat unit, and a gate of the second start transistor is electrically connected with a second control line, wherein in the m levels of first repeat units, among the second to m-th levels of first repeat units, the first input terminal of the first shift register in an i-th level of first repeat unit is electrically connected with the first output terminal of the first shift register in the (i−1)-th level of first repeat unit, and wherein in the n levels of second repeat units, among the second to n-th levels of second repeat units, the second input terminal of the second shift register in an i-th level of second repeat unit is electrically connected with the second output terminal of the second shift register in the (i−1)-th level of second repeat unit, and wherein m, n and i are positive integers, and i is greater than or equal to 2 and less than or equal to at least one of m and n, and wherein a frame comprises a first period of time and a second period of time, wherein: in two dimensional (2D) display: during the first period of time and during the second period of time, the first control line controls the first start transistor to be turned on, and the second control line controls the second start transistor to be turned on; and in three dimensional (3D) display: during the first period of time, the first control line controls the first start transistor to be turned on, and the second control line controls the second start transistor to be turned off; and during the second period of time, the first control line controls the first start transistor to be turned off and the second control line controls the second start transistor to be turned on, and wherein the TFT array substrate further comprises a first clock signal line, a first clock transistor, a second clock transistor, a second clock signal line, a third clock transistor, and a fourth clock transistor, wherein the first shift register further comprises a first clock signal terminal, and a third clock signal terminal, and wherein the second shift register further comprises a second clock signal terminal and a fourth clock signal terminal, wherein: in each level of first repeat unit: a drain of the first clock transistor is electrically connected with the first clock signal line, a gate of the first clock transistor is electrically connected with the first control line, and a source of the first clock transistor is electrically connected with the first clock signal terminal; and a drain of the third clock transistor is electrically connected with the second clock signal line, a gate of the third clock transistor is electrically connected with the first control line, and a source of the third clock transistor is electrically connected with the third clock signal terminal; and in each level of second repeat unit: a drain of the second clock transistor is electrically connected with the first clock signal line, a gate of the second clock transistor is electrically connected with the second control line, and a source of the second clock transistor is electrically connected with the second clock signal terminal; and a drain of the fourth clock transistor is electrically connected with the second clock signal line, a gate of the fourth clock transistor is electrically connected with the second control line, and a source of the fourth clock transistor is electrically connected with the fourth clock signal terminal, wherein: in the 2D display: during the first period of time and during the second period of time: the first control line controls the first clock transistor and the third clock transistor to be turned on, and the second control line controls the second clock transistor and the fourth clock transistor to be turned on; and in the 3D display: during the first period of time: the first control line controls the first clock transistor and the third clock transistor to be turned on, and the second control line controls the second clock transistor and the fourth clock transistor to be turned off; and during the second period of time: the first control line controls the first clock transistor and the third clock transistor to be turned off, and the second control line controls the second clock transistor and the fourth clock transistor to be turned on.

7. A display panel, comprising:

a thin film transistor (TFT) array substrate, the TFT array substrate further comprises:

a plurality of gate lines;

a first gate drive circuit, wherein the first gate drive circuit comprises m levels of first repeat units, wherein the m levels of first repeat units further comprise a first level of first repeat unit to an m-th level of first repeat unit sequentially arranged, wherein each level of the m levels of first repeat units further comprises a first shift register, wherein the first shift register further comprises a first input terminal and a first output terminal connected with a corresponding gate line;

a second gate drive circuit, wherein the second gate drive circuit comprises n levels of second repeat units, wherein the n levels of second repeat units further comprise a first level of second repeat unit to an n-th level of second repeat unit sequentially arranged, wherein each level of the n levels of second repeat units further comprises a second shift register, wherein the second shift register further comprises a second input terminal and a second output terminal connected with a corresponding gate line;

a first start signal line; a first start transistor, wherein a drain of the first start transistor is electrically connected with the first start signal line, a source of the first start transistor is electrically connected with the first input terminal of the first shift register of the first level of first repeat unit, and a gate of the first start transistor is electrically connected with a first control line; and a second start transistor, wherein a drain of the second start transistor is electrically connected with the first start signal line, a source of the second start transistor is electrically connected with the second input terminal of the second shift register of the first level of second repeat unit, and a gate of the second start transistor is electrically connected with a second control line, wherein in the m levels of first repeat units, among the second to m-th levels of first repeat units, the first input terminal of the first shift register in an i-th level of first repeat unit is electrically connected with the first output terminal of the first shift register in the (i−1)-th level of first repeat unit, and wherein in the n levels of second repeat units, among the second to n-th levels of second repeat units, the second input terminal of the second shift register in an i-th level of second repeat unit is electrically connected with the second output terminal of the second shift register in the (i−1)-th level of second repeat unit, and wherein m, n and i are positive integers, and i is greater than or equal to 2 and less than or equal to at least one of m and n, and wherein a frame comprises a first period of time and a second period of time, wherein: in two dimensional (2D) display: during the first period of time and during the second period of time, the first control line controls the first start transistor to be turned on, and the second control line controls the second start transistor to be turned on; and in three dimensional (3D) display: during the first period of time, the first control line controls the first start transistor to be turned on, and the second control line controls the second start transistor to be turned off; and during the second period of time, the first control line controls the first start transistor to be turned off and the second control line controls the second start transistor to be turned on, and wherein the TFT array substrate further comprises a first signal line, a first transistor and a second transistor; and the first shift register further comprises a first terminal, and the second shift register further comprises a second terminal, wherein: in the each level of first repeat unit, a drain of the first transistor is electrically connected with the first signal line, a gate of the first transistor is electrically connected with the first control line, and a source of the first transistor is electrically connected with the first terminal; and in each level of the second repeat unit, a drain of the second transistor is electrically connected with the first signal line, a gate of the second transistor is electrically connected with the second control line, and a source of the second transistor is electrically connected with the second terminal, wherein: in the 2D display: during the first period of time and during the second period of time, the first control line controls the first transistor to be turned on, and the second control line controls the second transistor to be turned on; and in the 3D display: during the first period of time, the first control line controls the first transistor to be turned on, and the second control line controls the second transistor to be turned off, and during the second period of time, the first control line controls the first transistor to be turned off, and the second control line controls the second transistor to be turned on.

* * * * *